US007538274B2

(12) United States Patent
Bertini et al.

(10) Patent No.: US 7,538,274 B2
(45) **Date of Patent: *May 26, 2009**

(54) SWAGABLE HIGH-PRESSURE CABLE CONNECTORS HAVING IMPROVED SEALING MEANS

(75) Inventors: Glen J. Bertini, Tacoma, WA (US); Anthony Roy Theimer, Auburn, WA (US)

(73) Assignee: Novinium, Inc., Kent, WA (US)

( * ) Notice: Subject to any disclaimer, the term of this patent is extended or adjusted under 35 U.S.C. 154(b) by 21 days.

This patent is subject to a terminal disclaimer.

(21) Appl. No.: 11/625,264

(22) Filed: Jan. 19, 2007

(65) Prior Publication Data

US 2007/0169954 A1 Jul. 26, 2007

Related U.S. Application Data

(60) Provisional application No. 60/761,099, filed on Jan. 23, 2006.

(51) Int. Cl.
*H01R 4/00* (2006.01)

(52) U.S. Cl. ..... 174/84 R; 174/88 R

(58) Field of Classification Search ..... 174/84 R, 174/88 R, 77 R, 93

See application file for complete search history.

(56) References Cited

U.S. PATENT DOCUMENTS

| | | | |
|---|---|---|---|
| 2,080,271 | A | 5/1937 | Hirst et al. |
| 2,247,671 | A | 7/1941 | Tepei |
| 2,938,940 | A | 5/1960 | Calendine et al. |
| 2,958,844 | A | 11/1960 | Smith et al. |
| 3,036,147 | A | 5/1962 | Wheaton |

(Continued)

FOREIGN PATENT DOCUMENTS

| | | |
|---|---|---|
| DE | 3149048 | 6/1983 |

(Continued)

OTHER PUBLICATIONS

Primedia Business Magazines & Media Inc.: Transmission & Distribution World; "Submarine Cable Rescued With Silicone-Based Fluid"; Jul. 1, 1999; 4 pgs; USA.

(Continued)

*Primary Examiner*—Chau N Nguyen
(74) *Attorney, Agent, or Firm*—Davis Wright Tremaine LLP; George C. Rondeau, Jr.

(57) ABSTRACT

A high-pressure connector for an electrical power cable section having a central stranded conductor encased in a polymeric insulation jacket and having an interstitial void volume in the region of the stranded conductor, the high-pressure connector being suited for confining a fluid within the interstitial void volume at a residual pressure above atmospheric, but below the elastic limit of the polymeric insulation jacket, the high-pressure connector comprising a housing having a wall defining an interior chamber configured to be in fluid communication with the interstitial void volume and an end portion sized to receive the insulation jacket within the interior chamber and to overlap at least a portion of the insulation jacket at an end thereof with the cable section extending from the housing end portion and at least a portion of the stranded conductor positioned within the interior chamber. The housing wall of the housing end portion has an engagement portion comprised of a swagable material to secure the housing wall to the insulation jacket in fluid-tight sealed engagement therewith upon inward swaging of the engagement portion of the housing wall of the housing end portion to the insulation jacket to confine the fluid at the residual pressure within the interior chamber and the interstitial void volume. The housing includes at least one axially-projecting engagement member located within the interior chamber at the engagement portion of the housing wall of the housing end portion.

57 Claims, 23 Drawing Sheets

U.S. PATENT DOCUMENTS

| | | | | |
|---|---|---|---|---|
| 3,141,060 | A | | 7/1964 | Norton |
| 3,242,255 | A | | 3/1966 | Falkenstein et al. |
| 3,457,359 | A | | 7/1969 | Soucy |
| 3,717,717 | A | | 2/1973 | Cunningham et al. |
| 3,810,078 | A | | 5/1974 | Chordas |
| 3,812,448 | A | * | 5/1974 | Haitmanek ..... 439/421 |
| 3,816,641 | A | | 6/1974 | Iverson |
| 3,823,254 | A | | 7/1974 | Smith |
| 3,845,450 | A | | 10/1974 | Cole et al. |
| 3,846,578 | A | | 11/1974 | Bahder et al. |
| 3,848,451 | A | | 11/1974 | Allen |
| 3,883,208 | A | | 5/1975 | Sankey et al. |
| 3,939,882 | A | | 2/1976 | Gillemot |
| 3,945,700 | A | | 3/1976 | Didier |
| 3,961,127 | A | | 6/1976 | Gear, Jr. et al. |
| 3,992,569 | A | | 11/1976 | Hankins et al. |
| 4,144,404 | A | | 3/1979 | De Groef et al. |
| 4,174,145 | A | | 11/1979 | Oeschger et al. |
| 4,345,783 | A | | 8/1982 | Bergstrand |
| 4,372,988 | A | | 2/1983 | Bahder |
| 4,375,577 | A | | 3/1983 | Silver et al. |
| 4,403,110 | A | | 9/1983 | Morrisette |
| 4,450,318 | A | | 5/1984 | Scardina et al. |
| 4,477,376 | A | | 10/1984 | Gold |
| 4,479,690 | A | | 10/1984 | Inouye et al. |
| 4,484,022 | A | | 11/1984 | Eilentropp |
| 4,503,283 | A | | 3/1985 | Hancock et al. |
| 4,515,426 | A | | 5/1985 | Bager |
| 4,545,133 | A | | 10/1985 | Fryszczyn et al. |
| 4,621,168 | A | | 11/1986 | Bryant et al. |
| 4,642,415 | A | | 2/1987 | Lanfranconi et al. |
| 4,723,230 | A | | 2/1988 | Chelminski |
| 4,764,232 | A | | 8/1988 | Hunter |
| 4,766,011 | A | | 8/1988 | Vincent et al. |
| 4,831,214 | A | | 5/1989 | Wilck |
| 4,845,309 | A | | 7/1989 | Vincent et al. |
| 4,888,886 | A | | 12/1989 | Eager, Jr. et al. |
| 4,943,685 | A | | 7/1990 | Reynart |
| 4,945,653 | A | | 8/1990 | Eager, Jr. et al. |
| 4,946,393 | A | | 8/1990 | Borgstrom et al. |
| 4,959,022 | A | | 9/1990 | Neuroth |
| 4,961,961 | A | | 10/1990 | Vincent et al. |
| 4,978,694 | A | | 12/1990 | Vincent et al. |
| 5,006,286 | A | | 4/1991 | Dery et al. |
| 5,069,058 | A | | 12/1991 | Hyatt |
| 5,082,449 | A | | 1/1992 | Borgstrom et al. |
| 5,115,950 | A | | 5/1992 | Rohr |
| 5,132,495 | A | | 7/1992 | Ewing et al. |
| 5,231,249 | A | | 7/1993 | Kimura et al. |
| 5,245,133 | A | | 9/1993 | DeCarlo et al. |
| 5,372,840 | A | | 12/1994 | Kleyer et al. |
| 5,372,841 | A | | 12/1994 | Kleyer et al. |
| 5,408,047 | A | | 4/1995 | Wentzel |
| 5,796,045 | A | | 8/1998 | Lancien et al. |
| 5,804,767 | A | | 9/1998 | Winfield et al. |
| 5,907,128 | A | | 5/1999 | Lanan et al. |
| 6,005,055 | A | | 12/1999 | Dammert et al. |
| 6,332,785 | B1 | | 12/2001 | Muench et al. |
| 6,338,637 | B1 | | 1/2002 | Muench, Jr. et al. |
| 6,489,554 | B1 | | 12/2002 | Bertini et al. |
| 6,517,366 | B2 | | 2/2003 | Bertini et al. |
| 6,916,193 | B2 | | 7/2005 | Varreng et al. |
| 7,195,504 | B2 | * | 3/2007 | Bertini et al. ..... 439/201 |
| 7,353,601 | B1 | | 4/2008 | Bertini et al. |
| 2002/0046865 | A1 | | 4/2002 | Bertini et al. |
| 2005/0189130 | A1 | | 9/2005 | Bertini et al. |
| 2005/0191910 | A1 | | 9/2005 | Bertini et al. |
| 2005/0192708 | A1 | | 9/2005 | Bertini |
| 2007/0046668 | A1 | | 3/2007 | Bertini |

FOREIGN PATENT DOCUMENTS

| | | |
|---|---|---|
| ES | 92309362.9 | 4/1993 |
| GB | 870165 | 6/1961 |
| GB | 2037498 | 7/1980 |

OTHER PUBLICATIONS

Glen J. Bertini; "Entergy Metro Case Study: Post- Treatment Lessons", ICC meeting; Apr. 1997; Scottsdale, Arizona; USA.

Glen J. Bertini et al.; "Silicone Strand-Fill : A New Material and Process", Insulated Conductors Committee (ICC) meeting; Spring 1990; 11 pgs; Dearborn Michigan; USA.

U.S. Appl. No. 11/379,979, filed Apr. 24, 2006, Bertini.

U.S. Appl. No. 11/468,274, filed Aug. 29, 2006, Bertini et al.

U.S. Appl. No. 11/625,251, filed Jan. 19, 2007, Bertini et al.

* cited by examiner

SWAGABLE HIGH-PRESSURE CABLE CONNECTORS HAVING IMPROVED SEALING MEANS

CROSS REFERENCE TO RELATED APPLICATION(S)

This application claims priority benefit of provisional application Ser. No. 60/761,099 filed Jan. 23, 2006, which is incorporated herein in its entirety.

FIELD OF THE INVENTION

The present invention relates to a swagable high-pressure connector especially suited for injecting a dielectric enhancement fluid into the interstitial void volume of an electrical power cable at elevated pressures and confining the fluid therein at a similar elevated pressure.

DESCRIPTION OF THE RELEVANT ART

Swagable high-pressure connectors were previously described in United States Patent Application Publication No. US 2005/0191910. An example of a dual-housing, swagable high-pressure splice connector, assembled from two identical swagable high-pressure terminal connectors, is illustrated in FIG. 8 of this publication and is reproduced herein as FIG. 1. The housing 100 is swaged to the insulation jacket 12 such that teeth 32 penetrate the latter to provide a leak-free seal therewith (up to about 1000 psig) at ambient temperatures. These high-pressure connectors are specifically intended for use in a method for injecting a dielectric enhancement fluid into the interstitial void volume of an electrical cable section under a sustained elevated pressure in order to restore the dielectric properties of the cable, as fully described in United States Patent Application Publication No. US 2005/0189130. The elevated pressure injection method is applied to an in-service electrical cable section having a central stranded conductor encased in a polymeric insulation jacket (typically also having a conductor shield between the conductor and the insulation jacket) and having an interstitial void volume in the region of the conductor.

The term cable "segment," as used herein, refers to the section of cable between two terminal connectors, while a cable "sub-segment" is defined as a physical length of uninterrupted (i.e., uncut) cable extending between the two ends thereof. Thus, a cable segment is identical with a sub-segment when no splices are present between two connectors. Otherwise, a sub-segment can exist between a terminal connector and a splice connector or between two splice connectors, and a cable segment can comprise one or more sub-segments. For the sake of efficiency, the term "cable section" will be used herein to designate either a cable segment or a cable sub-segment while the specific terms will be applied as appropriate.

Briefly stated, the method comprises filling the interstitial void volume with a dielectric property-enhancing fluid at a pressure below the elastic limit of the polymeric insulation jacket, and confining the fluid within the interstitial void volume at a residual pressure greater than about 50 psig. As used herein, the term "elastic limit" of the insulation jacket of a cable section is defined as the internal pressure in the interstitial void volume at which the outer diameter (OD) of the insulation jacket takes on a permanent set at 25° C. greater than 2% (i.e., the OD increases by a factor of 1.02 times its original value), excluding any expansion (swell) due to fluid dissolved in the cable components. This limit can, for example, be experimentally determined by pressurizing a sample of the cable section with a fluid having a solubility of less than 0.1 % by weight in the conductor shield and in the insulation jacket (e.g., water), for a period of about 24 hours, after first removing any covering such as insulation shield and wire wrap. Twenty four hours after the pressure is released, the final OD is compared with the initial OD in making the above determination. For the purposes herein, it is preferred that the residual pressure is no more than about 80% of the above defined elastic limit. The residual pressure is imposed along the entire length of the section, whereby the residual pressure within the void volume promotes the transport of the dielectric property-enhancing fluid into the polymeric insulation. After the cable is filled and pressurized with the fluid, the feed is disconnected and the pressure begins to immediately decay due to diffusion transport of the fluid into the conductor shield and the insulation jacket of the cable. At room temperature, the decay to zero gage pressure typically takes several months to about a year; at 55° C. the decay to zero usually takes only a few days.

The swaging process used to form the seal between the insulation jacket and the housing of the above high-pressure connectors, described fully in the above mentioned publications, prevents "pushback" of the insulation jacket and generally satisfies the short term sealing requirement. Pushback is defined herein as the axial movement of the insulation jacket and conductor shield away from the cut end (crimped end) of the conductor of a cable section when a fluid is confined within its interstitial void volume at a high residual pressure. Absent substantial and prolonged temperature cycling, these swagable devices are probably adequate for over 80% of existing underground lateral residential distribution cables (URD). Conversely, these swagable devices are probably inadequate for over 80% of existing underground feeder distribution, sub-transmission, or transmission cables (hereinafter Feeder cables) where conductor temperature swings of over 20° C. in a 24 hour period are common and peak conductor temperatures may periodically approach the common design temperature of 90° C., in extreme cases approaching the thermal overload temperature of 130° C. A more resilient seal is desirable in order to assure reliable performance of the above high-pressure devices, particularly for use with Feeder cables.

Moreover, a durable seal is also needed because a long-term low pressure requirement remains for several years due to the dielectric enhancement fluid retained in the interstitial void volume of the cable. Potential long-term damage from leaking fluid is mitigated by the changing properties of the remaining fluid, which typically includes at least one organoalkoxysilane monomer component that hydrolyzes and oligomerizes within the cable upon reaction with adventitious water, as described in U.S. Pat. No. 4,766,011. The oligomers resulting from the hydrolysis and condensation of the organoalkoxysilane have a correspondingly higher viscosity and lower solubility in polymers than do the originally injected organoalkoxysilane monomers, and therefore do not exude from the cable as readily. However, leak-free performance is still highly desirable since there remains some chance of damage to the splice or termination from even a minor leak. Furthermore, any fluid that leaks from the connector would not be available to treat and restore the cable dielectric properties, and there may also be undesirable environmental and safety consequences of such a leak.

BRIEF SUMMARY OF THE INVENTION

There is disclosed a high-pressure connector for an electrical power cable section having a central stranded conductor encased in a polymeric insulation jacket and having an interstitial void volume in the region of the stranded conductor, the high-pressure connector being suited for confining a fluid within the interstitial void volume at a residual pressure above atmospheric, but below the elastic limit of the polymeric insulation jacket, the high-pressure connector comprising:

a housing having a wall defining an interior chamber configured to be in fluid communication with the interstitial void volume, the housing having an end portion with the housing wall thereof sized to receive the insulation jacket within the interior chamber and to overlap at least a portion of the insulation jacket at an end thereof with the cable section extending from the housing end portion and at least a portion of the stranded conductor positioned within the interior chamber, the housing wall of the housing end portion having an engagement portion comprised of an inwardly deformable material to secure the housing wall to the insulation jacket in fluid-tight sealed engagement therewith upon inward deformation of the engagement portion of the housing wall of the housing end portion to the insulation jacket to confine the fluid at the residual pressure within the housing interior chamber and the interstitial void volume, the housing having at least one axially-projecting engagement member located essentially at the wall defining the interior chamber of the housing and positioned within the engagement portion.

DETAILED DESCRIPTION OF THE INVENTION

Figure 1:
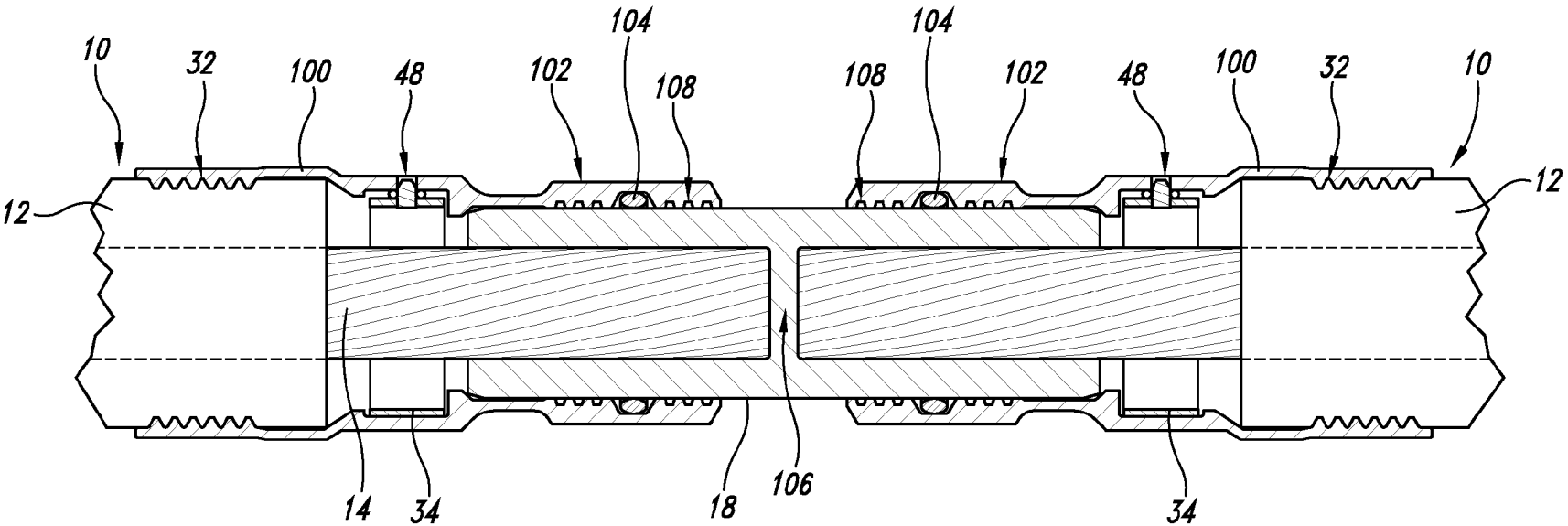
FIG. 1 is a reproduction of a partial cross-sectional view of a high-pressure swagable splice connector taught in Publication No. US 2005/0191910.

It has been determined that, when swagable high-pressure connectors of the type shown in FIG. 1 are subjected to substantial thermal cycling, the insulation jacket can separate from the inside surface of the housing. While not wishing to be bound by any particular theory or mechanism, it is believed that the basis for this observation may be explained by way of the following illustration. The coefficient of thermal expansion for a typical insulation polymer, cross linked low density polyethylene (XLPE), varies from about 0.00020° $C.^{-1}$ to about 0.0011° $C.^{-1}$ over the range from 0° C. to 90° C., this being about 38 to 200 times higher than the coefficient for the typical stainless steel (SS) housing of the high-pressure connector, which is 0.0000053° $C.^{-1}$. Thus, as the temperature of the connector/cable increases with increased cable load, the polyethylene in the region of the swage is compressed due to the disparity of the respective thermal coefficients. This, in turn, urges the insulation polymer in the region of the swage to flow (i.e., creep) axially away from the interface with the housing since inward radial flow is essentially blocked by the conductor. When the temperature again declines as load decreases (i.e., a typical load cycle during a 24 hour period), the outer surface of the insulation recedes radially from the inner surface of the housing in the region of the swage to form a finite gap therebetween. This potentially creates a leakage path for any pressurized fluid within the cable interior. Such leaks have been experimentally observed when cable sections employing experimental high-pressure terminal connectors of the type shown in FIG. 1 (i.e., one side of the splice connector) and containing air under pressure were subjected to accelerated temperature cycling, as further described below.

Figure 2:
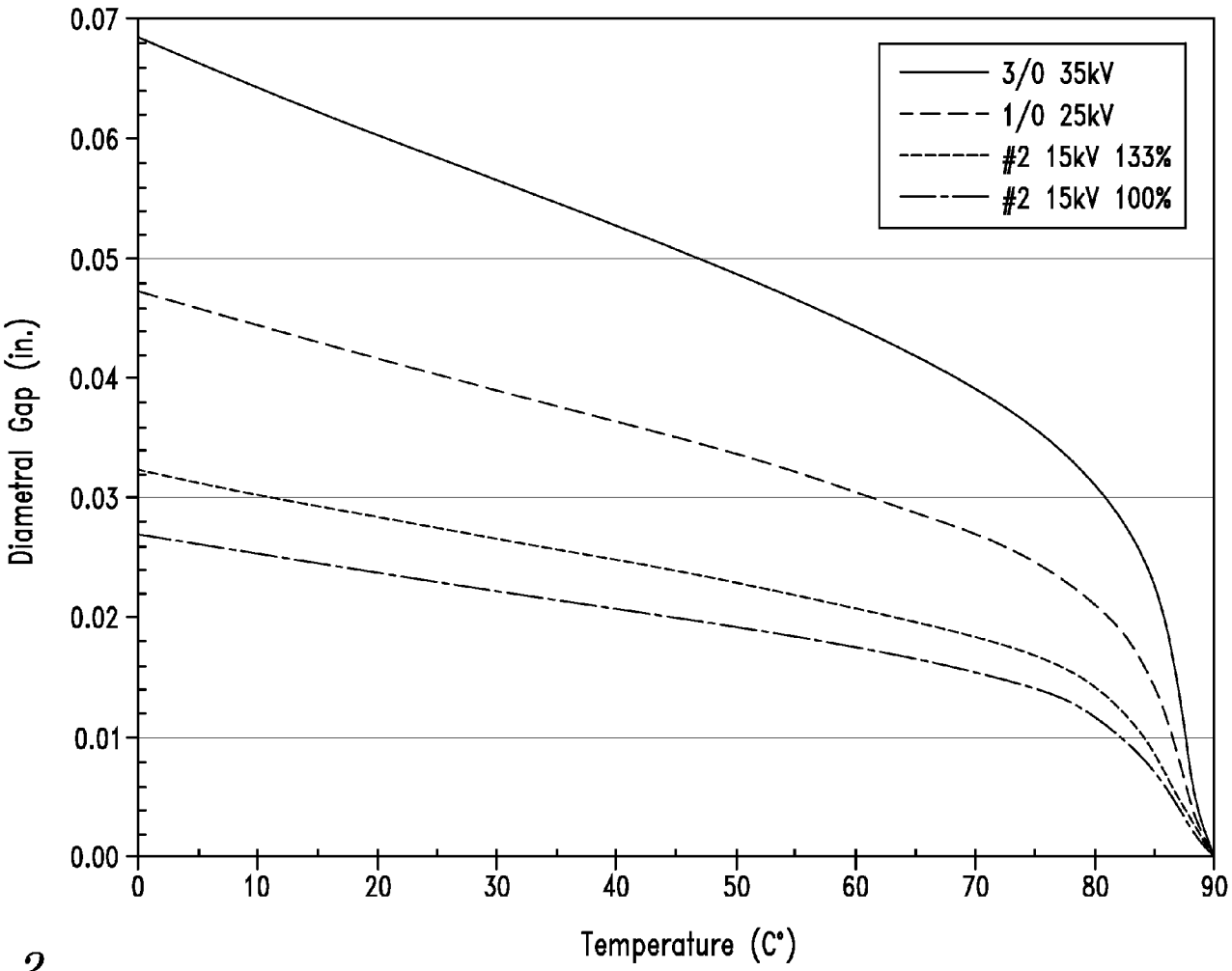
FIG. 2 is a plot of the calculated maximum (diametral) gap between the housing and insulation jacket for representative cables created by repeated thermal cycling as a function of temperature.

Assuming all parts of the assembly are at the same temperature at any given time, the conductor is an essentially incompressible solid (e.g., a copper or aluminum stranded conductor), the insulation shield has essentially the same properties as the insulation jacket, the compressive stress in the insulation approaches zero after sufficiently long times to represent the worst possible case, and the calculated maximum diametral gap for a temperature cycle range of $\Delta T=90°$ C. is about 0.068 inches for insulation typical of 35 kV cables and conductor sizes larger than 125 $mm^2$ (250 kcm). The calculated diametral gap is about 0.027 inches for insulation typical of 15 kV cables and conductor sizes smaller than 125 $mm^2$ (250 kcm). This relationship is demonstrated graphically in FIG. 2 for several representative cable geometries, wherein the conductor size is American Wire Gage (AWG), and the insulation has the nominal thickness for the indicated voltage class per industry standard ICEA S-94-649. In this figure, the X-axis is the temperature range of a given thermal cycle (e.g., for a 3/0 35 kV cable and a cycle between 90° C. and 20° C., the approximate maximum diametral gap is about 0.06 inch).

The initial residual gage pressure due to injection of fluid can be as high as about 1000 psig, as described in US 2005/0191910. However, this residual pressure typically decays to essentially zero after a modest time (e.g., about a year) and the remaining long-term pressure within the connector includes two components. The first component is the fluid head pressure which, for most cases, is generally close to 0 psig (pounds per square inch gage). A reasonable maximum design pressure due to fluid head which is likely to persist where typical residential rolling hills are present (e.g., a maximum 60 foot elevation change in a single sub-segment) is therefore about 30 psig. The second long-term pressure component is attributed to the vapor pressure of any residual fluid. The sum of these two pressure components should be accommodated by the connector.

Figure 3:
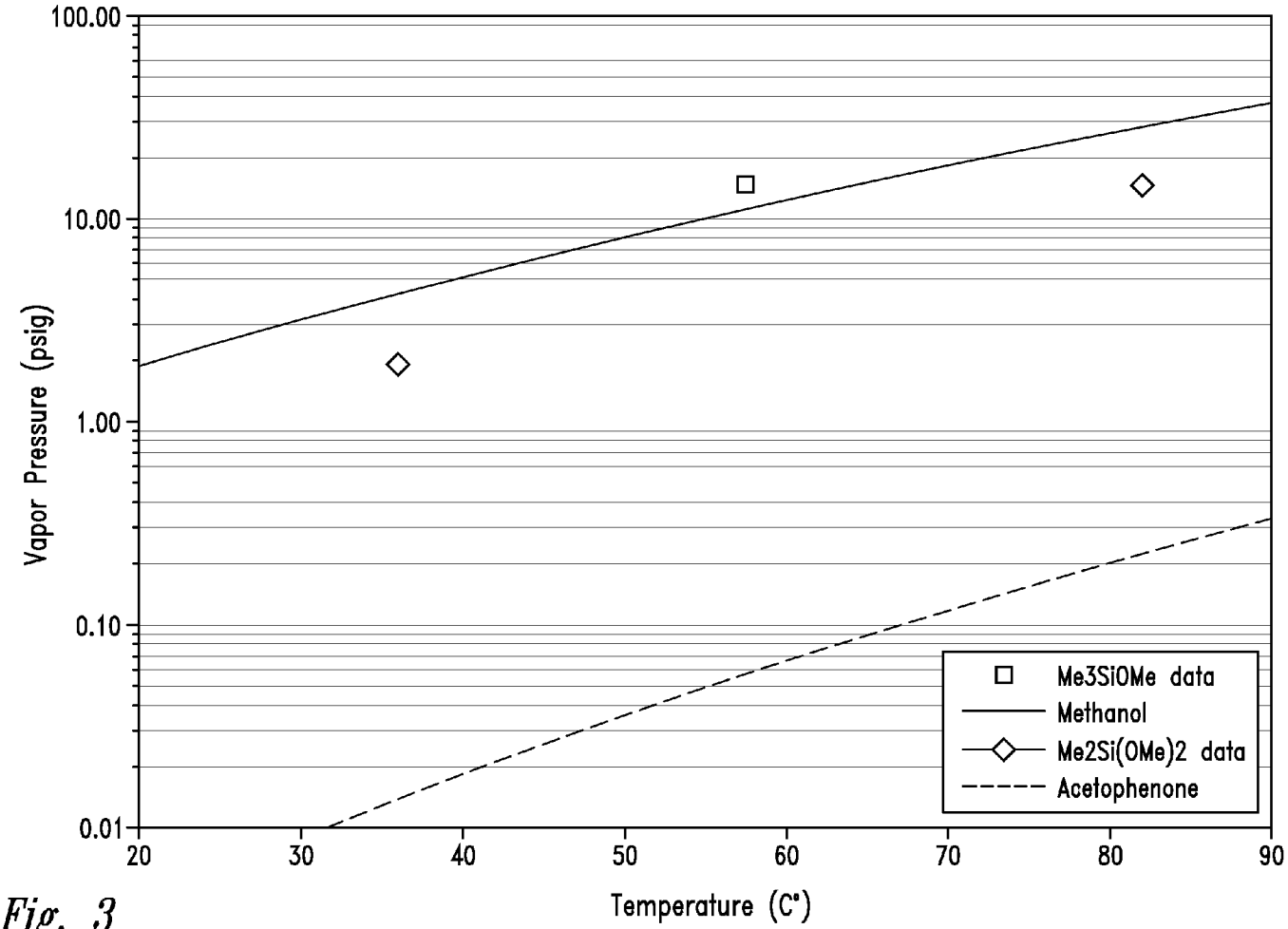
FIG. 3 is a plot of pure component vapor pressure for trimethylmethoxysilane, MeOH, dimethyidimethoxysilane and acetophenone as a function of temperature.

The vapor pressure of a typical monomeric organoalkoxysilane employed as the dielectric enhancement fluid in cable restoration methods is less than about 1 psig at temperatures up to 90° C., and even a more volatile dielectric enhancement fluid component, such as acetophenone (represented by the dashed line in FIG. 3), has a relatively low vapor pressure at typical cable operating temperatures. However, methanol, which is a by-product of hydrolysis of the organo-functional methoxysilanes usually employed as dielectric enhancement fluids, can make up a substantial portion of the fluid in the cable's interior and may take up to several years to approach a zero concentration. The vapor pressure of methanol as a function of temperature is also plotted in FIG. 3 and its value can approach approximately 30 psig for cables running at their maximum design ampacity. Prior art cable restoration methods, described by U.S. Pat. Nos. 5,372,840 and 5,372,841, use more volatile components, such as dimethyldimethoxysilane (data represented by diamonds in FIG. 3) and trimethylmethoxysilane (datum represented by the square in FIG. 3). These volatile components may require even higher design pressures. However, in the case of materials with boiling points below 60° C., such as trimethylmethoxysilane, there often is another limitation which occurs prior to any potential leak at a connector. As the temperature of the cable approaches 90° C., the physical properties of the insulation polymer degrade substantially and physical, as well as electrical, failure of the cable is likely due to cable "ballooning." It is therefore highly desirable that the high-pressure cable connector withstand the maximum possible vapor pressure which the cable can withstand without ballooning while operating at a cable conductor temperature of up to 90° C. Hence, in order to accommodate the combination of a fluid head of 60 feet as well as the partial pressure of methanol in the strands (i.e., interstitial void volume or interior of the cable) at up to a peak of 90° C., the cable connector should be capable of withstanding a long-term total pressure of approximately 60 psig at the peak temperature without leaking when the temperature declines more than about 20° C. from its peak during in-service thermal cycling.

Thus, although United States Patent Application Publication No. US 2005/0191910, hereby incorporated by reference, and Publication No. US 2005/0189130, each teaches swagable high-pressure connectors having axial restraint of the connector with respect to the cable to prevent pushback, there is no provision to prevent radial separation (i.e., the above described diametral gap) of the connector housing from the cable's insulation resulting from the substantial thermal cycling common in many Feeder cables. For the purposes herein, "substantial thermal cycling" refers to thermal cycling wherein the mode (i.e., peak) of the distribution with respect to time of $\Delta T$, the difference between the high and low conductor temperatures, is at least about 20° C. Estimation of $\Delta T$ can be made for a given cable type and load conditions using methods well known in the art for calculating ampacity. In order to overcome leakage due to the above described (diametral) gap formation when the cable is subjected to the substantial temperature variations described above, the instant application teaches a high-pressure connector of the type illustrated in FIG. 1 having a more robust seal between the swaged housing and the cable's insulation jacket.

Accordingly, the instant high-pressure connector introduces a modification of the above described design wherein the improvement comprises a means for radially securing the housing to the insulation jacket of the cable such that these two elements are mated in generalized "dovetail" fashion after the swaging operation is completed, and particularly after the cable is subjected to an electrical load and the elevated temperatures associated therewith. This generalized "dovetail" arrangement resists the radial separation of the housing from the insulation jacket when the connector and cable undergo substantial thermal cycling. As a result, the improved high-pressure connectors described herein can withstand the effects of the greatest temperature fluctuations likely to be encountered in actual cable operation and be leak-free at the above described residual pressures. This securing means can comprise an axially-projecting engagement member, which in some disclosed embodiments is referred to as an axially-projecting, circumferentially-extending spur which in some embodiments takes the form of an axially-projecting circumferential ridge disposed essentially along the inner periphery of the housing. There is thus presented a high-pressure connector for an electrical power cable section having a central stranded conductor encased in a polymeric insulation jacket and having an interstitial void volume in the region of the stranded conductor, the high-pressure connector being suited for confining a fluid within the interstitial void volume at a residual pressure above atmospheric, but below the elastic limit of the polymeric insulation jacket, the high-pressure connector comprising:

a housing having a wall defining an interior chamber configured to be in fluid communication with the interstitial void volume, the housing having an end portion with the housing wall thereof sized to receive the insulation jacket within the interior chamber and to overlap at least a portion of the insulation jacket at an end thereof with the cable section extending from the housing end portion and at least a portion of the stranded conductor positioned within the interior chamber, the housing wall of the housing end portion having an engagement portion comprised of a swagable material to secure the housing wall to the insulation jacket in fluid-tight sealed engagement therewith upon inward swaging of the engagement portion of the housing wall of the housing end portion to the insulation jacket to confine the fluid at the residual pressure within the housing interior chamber and the interstitial void volume and to prevent pushback of the insulation jacket at the residual pressure, the housing having at least one axially-projecting engagement member located essentially at the wall defining the interior chamber of the housing and positioned within the engagement portion.

Figure 5:
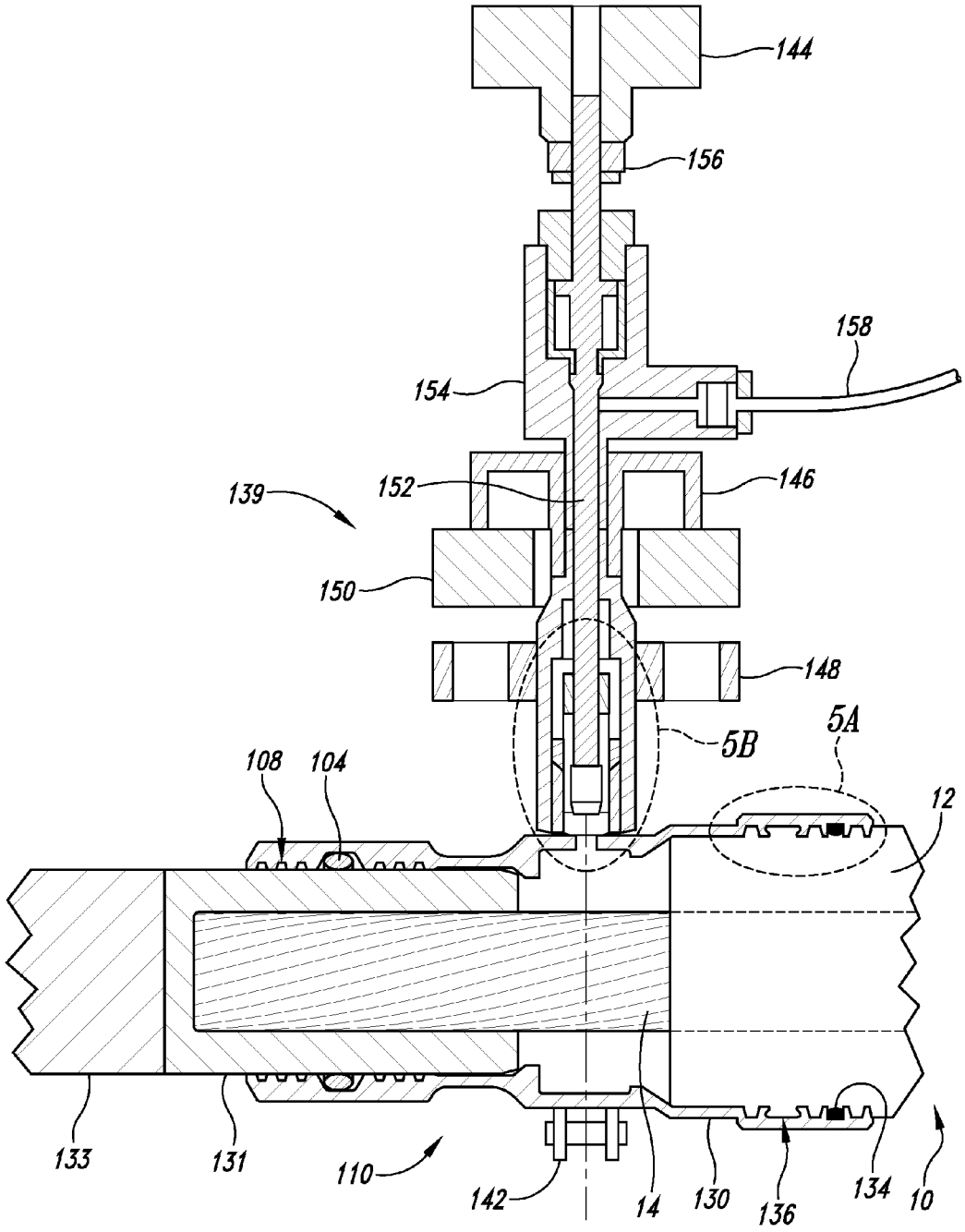
FIG. 5 shows a partial cross-sectional view of an injection tool clamped in position over a swagable high-pressure terminal connector having a generally trapezoidal recessed groove.
Figure 5A:
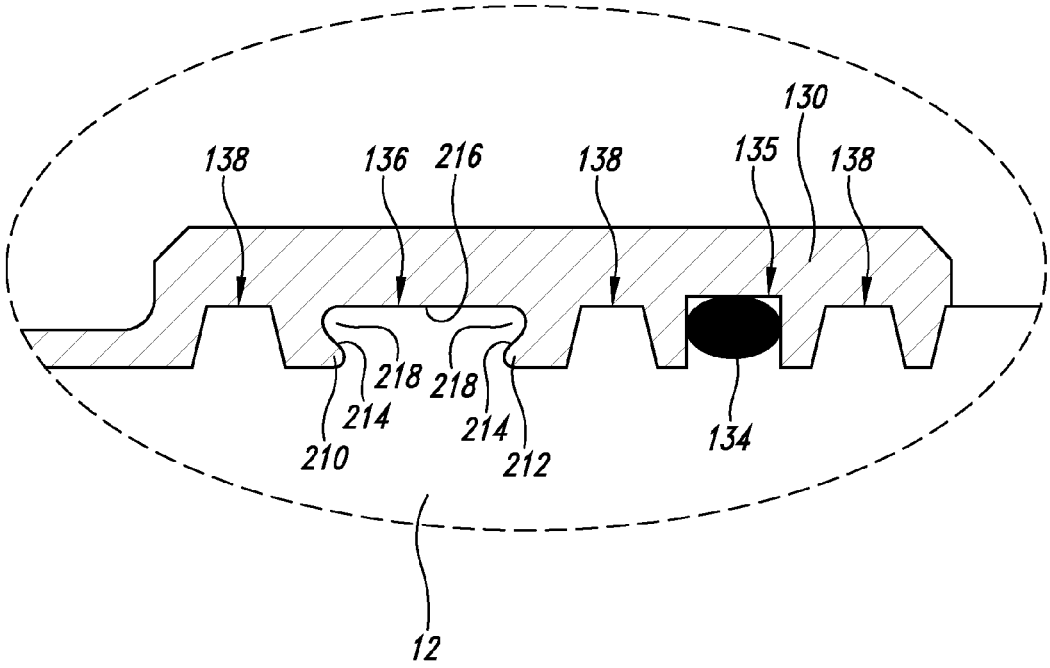
FIG. 5A is a cross-sectional view of detail area 5A of FIG. 5 showing the swaging region over the insulation jacket.

A swagable high-pressure terminal connector 110 of one type usable for injection of dielectric enhancement fluid into a cable section 10 and with which the described axially-projecting, circumferentially-extending spur can be used, is illustrated in FIG. 5 and described in greater detail below. As shown in FIG. 5, and described in Publication No. US 2005/0191910, the insulation jacket 12 of the cable section 10 is received within a first end portion of a housing 130 of the connector 110. The first end portion of the housing 130 is sized such that its internal diameter (ID) is just slightly larger than the outer diameter (OD) of insulation jacket 12. As will be described in greater detail below, the exterior of the first end portion of the housing 130 is swaged, as shown in FIG. 5A, over an O-ring 134 which resides in an interior circumferentially-extending O-ring groove 135 in housing 130, multiple interior circumferentially-extending Acme thread-shaped grooves 138 in the housing, and an interior circumferentially-extending generally trapezoidal groove 136 in the housing. This insulation swaging region is shown in detail in the DETAIL 5A of FIG. 5 and enlarged in FIG. 5A. In these, as well as other figures herein, the same reference numerals are applied to identical or corresponding elements. Further, as used herein, "swaging" or "circumferential crimping" refers to the application of radial, inwardly directed compression around the periphery of the housing over at least one selected axial position thereof. This swaging operation produces a circular peripheral indented region on the outer surface of the housing and inwardly projects a corresponding internal surface thereof into the insulation jacket (or a metallic crimp connector, or a bushing associated with the crimp connector, as further described below) so as to partially deform the latter at a periphery thereof. Swaging can be accomplished by various methods known in the art, such as the commercially available CableLok™ radial swaging tool offered by DMC, Gardena, Calif.

In a first aspect, with reference to the embodiment illustrated in FIGS. 5 and 5A by way of example, the trapezoidal groove 136 has a pair of oppositely-oriented, axially-projecting, circumferentially-extending spurs 210 and 212. The spurs 210 and 212 are disposed essentially at an interior wall of the housing 130, and project in opposite axial directions toward each other. The spurs 210 and 212 are provided by forming the circumferential groove 136 in the interior wall of the housing 130 at an axial position along the first end portion of the housing within the above described insulation swaging region over the insulation jacket (i.e., within the engagement portion of the housing). The circumferential groove 136 and the spurs 210 and 212, extend completely around the inner circumference of the inner wall of the housing 130. Each spur 210 and 212 has a generally radially outward facing wall 214 spaced radially inward from a radially inward facing recessed wall portion 216 of the housing 130 located within the groove. A pair of circumferentially-extending recesses 218 within the groove 136 are defined between the radially outward facing walls 214 of the spurs 210 and 212 and the radially inward facing recessed wall portion 216 of the housing 130. The recesses 218 form axially-opening undercut spaces located radially outward of the spurs within which a portion of the insulation jacket 12 of the cable section 10 is pressed and at least partially flows as a result of the swage applied to the exterior of the first end portion of the housing 130 in the insulation swaging region described above and the cable being placed in service. This operation forces at least some polymer of the insulation jacket 12 into the groove 136 and further into the recesses 218 (i.e., into the undercuts). Essentially, the polymer of the insulation jacket 12 within the groove 136 and the groove itself form an interlocking joint, much like a dovetail mortise and tenon joint or union. As a result, a fluid-tight seal is formed between the insulation jacket 12 and the housing 130, which not only prevents pushback of the insulation jacket, but also provides leak-free operation when the cable section contains fluid at elevated pressure and is subjected to substantial thermal cycling that otherwise might cause relative radial movement and separation of the insulation jacket and the housing, and hence fluid leakage during the cooling phase of a thermal cycle.

It has been observed that the polymer cold-flows into the recesses 218 under the intense compression associated with the swaging operation over the insulation jacket. Additional flow and conformation is believed to be facilitated by the rise in temperature due to electrical load when the cable is placed in service. External heating may also be provided to soften the insulation 12 and further aid the flow into the recesses 218 (e.g., a heating jacket, induction heating of the connector housing or steam heating).

Non-limiting examples of housing groove geometries contemplated herein to inhibit relative radial movement and separation of the insulation jacket and the housing are illustrated in FIGS. 4A through 4E, each of which shows a detailed cross-sectional view of one (top) wall of a connector housing (of the general types shown in FIGS. 1 and 5) wherein at least one axially-projecting circumferential spur is provided.

Figure 4A:
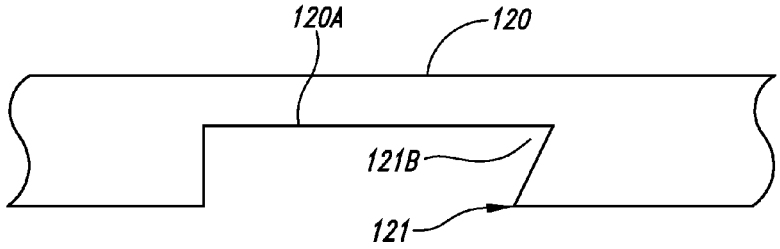
FIG. 4A is a detailed cross-sectional view of an angled groove formed in a connector housing.

FIG. 4A shows a detailed cross-sectional view of an interior circumferentially-extending angled groove 120A formed in a housing 120, resulting in a single axially-projecting circumferentially-extending spur 121 with a single circumferentially-extending recess 121B within the groove 120A and associated with the spur 121. As will be appreciated, while a pair of spurs 210 and 212 are provided by the groove 136 of FIGS. 5 and 5A, a single spur will also inhibit relative radial movement and separation of the insulation jacket and the housing.

Figure 4B:
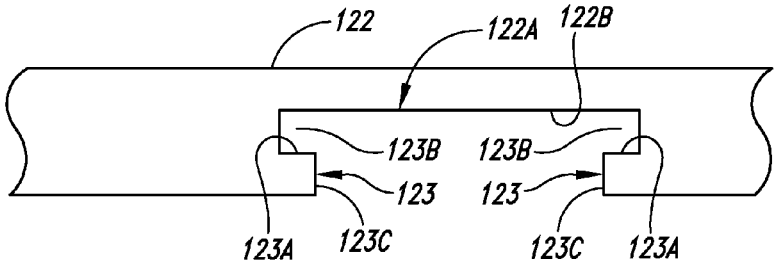
FIG. 4B shows a detailed cross-sectional view of a stepped groove formed in a connector housing.

FIG. 4B shows a detailed cross-sectional view of an interior circumferentially-extending stepped groove 122A formed in a housing 122, resulting in a pair of oppositely-oriented, axially-projecting circumferentially-extending spurs 123 that extend toward each other. Each spur 123 has a radially outward facing wall 123A spaced radially inward from a radially inward facing recessed wall portion 122B of the housing 122 located within the groove 122A. A circumferentially-extending recess 123B within the groove 122A is defined between the radially outward facing wall 123A of each spurs 123 and the radially inward facing recessed wall portion 122B of the housing 130. As described above, the recesses 123B form axially-opening undercut spaces located radially outward of the spurs within which a portion of the insulation jacket 12 of the cable section 10 is pressed and at least partially flows as a result of the swage applied to the exterior of a first end portion of the housing 122 in the insulation swaging region described above and the cable being placed in service. It is noted that the spurs 123 each have an axially facing wall 123C oriented in a radial plane which would tend by itself to not inhibit relative radial movement and separation of the insulation jacket and the housing.

Figure 4C:
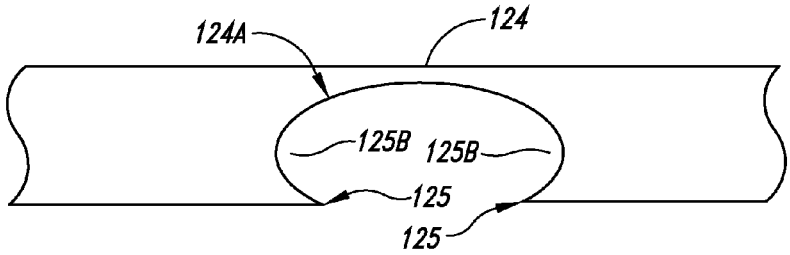
FIG. 4C shows a detailed cross-sectional view of an elliptical groove formed in a connector housing.

FIG. 4C shows a detailed cross-sectional view of an interior circumferentially-extending generally elliptical groove 124A formed in a housing 124, resulting in a pair of oppositely-oriented, axially-projecting circumferentially-extending incurvate spurs 125 that extend toward each other. Each of the spurs 125 has a circumferentially-extending recess 125B within the groove 124A and associated with the spur.

Figure 4D:
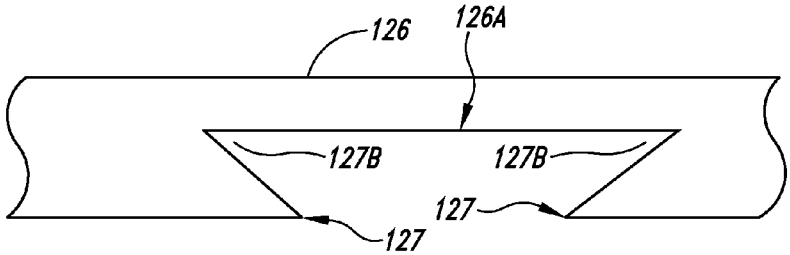
FIG. 4D shows a detailed cross-sectional view of a trapezoidal groove formed in a connector housing.

FIG. 4D shows a detailed cross-sectional view of an interior circumferentially-extending trapezoidal groove 126A formed in a housing 126, resulting in a pair of oppositely-oriented, axially-projecting circumferentially-extending angled spurs 127 that extend toward each other. Each of the spurs 127 has a circumferentially-extending recess 127B within the groove 126A and associated with the spur.

Figure 4E:
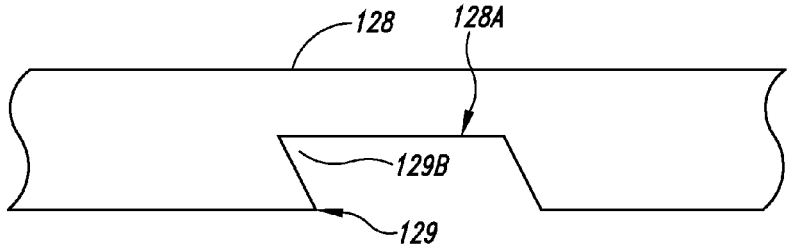
FIG. 4E shows a detailed cross-sectional view of a variation of the groove of FIG. 4A formed in a connector housing.

FIG. 4E shows a detailed cross-sectional view of a variation of the groove of FIG. 4A having an interior circumferentially-extending angled groove 128A formed in a housing 128, resulting in a single axially-projecting circumferentially-extending angled spur 129 with a single circumferentially-extending recess 129B within the groove 128A and associated with the spur 129.

Figure 15:
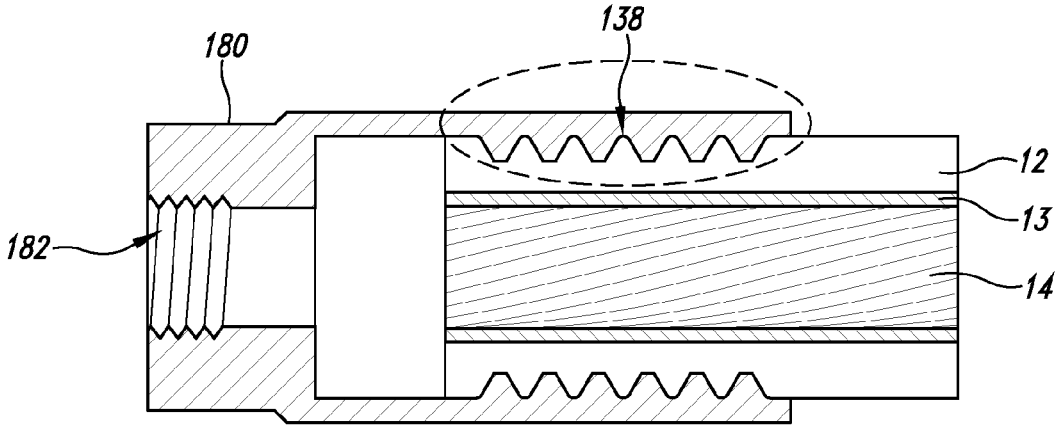
FIG. 15 is a cross-sectional view of a test connector having Acme thread-shaped grooves.

It should be apparent to those skilled in the art that the precise shape of the housing groove is not critical; however, it is desirable that the recess and at least one spur created are disposed essentially along the inner periphery of the housing wherein a wall of the spur adjacent to the recess has an axial component which can resist radial retraction of the polymer insulation from the housing during the cooling phase of a thermal cycle. In any of these embodiments, inwardly projecting engagement members (i.e., teeth) configured to deform and partially penetrate the insulation jacket along a periphery thereof may optionally be provided to secure the housing wall to the insulation jacket. Such teeth may be present at the inner wall of the housing within the region to be swaged over the insulation jacket (i.e., the engagement portion) and they can have triangular, square, rectangular or corrugated shapes. These optional teeth may be formed by cutting corresponding grooves in the housing wall. For example, FIGS. 5A and 15 illustrate roughly triangular-shaped teeth formed by Acme thread-shaped grooves 138 in housings 130 and 180, respectively. Alternatively, these additional teeth can be completely omitted, leaving an essentially smooth interior wall of the housing in the insulation swaging region except for the spurs and adjacent groove.

In one aspect of several of the embodiments discussed above, the longitudinal cross-sectional profile of the circumferential housing groove has recesses such that at least one internal axial dimension thereof (i.e., measured along the axis of the housing) is greater than the corresponding axial dimension of the groove toward the inner radius of the housing. In other words, as shown in FIG. 18, the groove has at least one dimension Xm which is greater than a radially inward groove dimension Xr, wherein Xm is the maximum groove axial dimension at a radius greater than r but less then R (such as measured within and between the recesses inward of the spurs), Xr is the groove axial dimension at radius r, r is the inner radius of the housing, and R is the outer radius of the housing.

Figure 18:
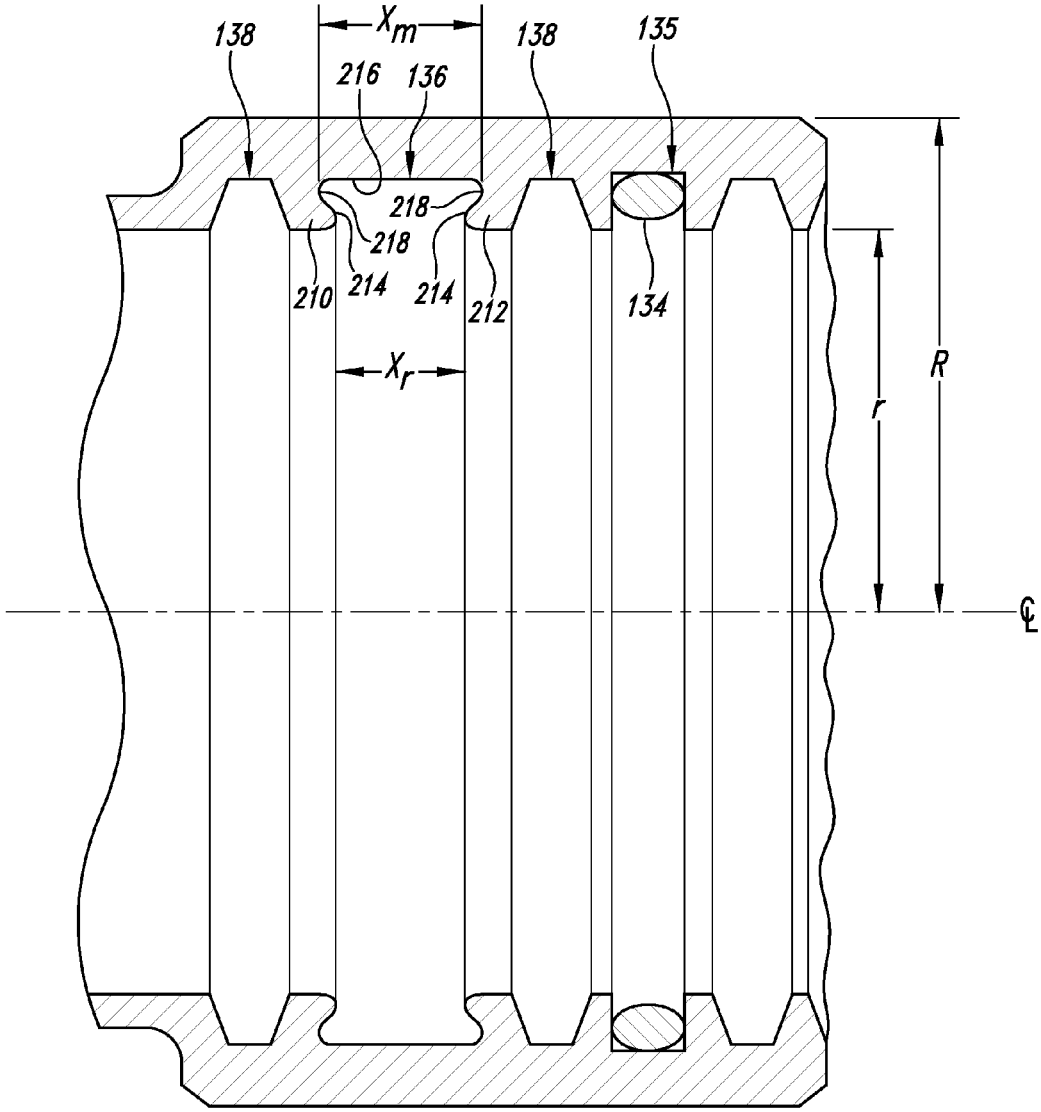
FIG. 18 is an enlarged fragmentary cross-sectional view of the swaging region of the connector of FIG. 5.

It is noted that "r" may be the inner radius of the housing as illustrated in FIG. 18, or another radially inward radial position within the interior chamber whereat the dimension Xr of the groove is less than the dimension Xm of the groove.

This relationship describes the trapezoidal groove of the embodiments of FIGS. 5 and 5A and the grooves depicted in FIGS. 4A through 4D. In the above embodiments, such as the trapezoidal groove 126A of FIG. 4D, the radially outward facing walls of the spurs can be flat or curved and the tip of the spur can be sharp or exhibit some rounding or bluntness, as exemplified by the trapezoidal groove of FIG. 5A.

The above described housing grooves may be formed in the housing by any suitable method known in the art, such as: lathe machining, milling, investment casting, and CNC operations. While the housings have been illustrated showing only a single housing groove (such as housing groove 136 shown in FIGS. 5 and 5A) for inhibiting relative radial movement and separation of the insulation jacket and the housing, it should be understood that the housing may be provided with two or more such housing grooves in the insulation swaging region of the housing.

In another embodiment, the housing of a high-pressure connector having any of the above described housing groove geometries can be further modified by adding an annular elastomeric element disposed between the outer surface of the insulation jacket and the inner wall of the housing in the insulation swaging region. Due to its relatively low modulus of elasticity and rubbery nature, such an elastomeric element can reversibly expand and contract to fill the gap caused by the thermal cycling and therefore act to block a potential leak. While elastomers can also develop a permanent set, the set is much less than that of the polyethylene (PE) typically employed as the insulation. Of course, the dimensions of the housing would have to be adjusted to accommodate the annular elastomeric element. Non-limiting examples of the elastomeric element include an elastomeric O-ring or an annular cylinder which will expand as the contacted polyethylene insulation jacket recedes from creep. This enhanced sealing means can be implemented either on the circumference of the insulation jacket (such as the O-ring 134 shown in FIG. 3 of above cited Publication No. US 2005/0191910) or on the polymer face (e.g., an O-ring against an end wall of the insulation jacket, as shown in FIG. 4 of above cited Publication No. US 2005/0191910). In each case, the elastomeric element preferably resides within a groove in the housing or in a groove in an appropriate washer, respectively. A further advantage of an annular elastomeric element is its relative insensitivity to rotational movements which may be imposed on a seal as the cable system is thermally cycled (e.g., where thermal expansion and contraction of the cable strands impart a torque on the cable) or as it is manipulated by workers during installation or maintenance operations.

In the embodiment of the high-pressure connector shown in FIGS. 5 and 5A, the insulation swaging region over the insulation jacket 12 (engagement portion of the housing 130) comprises at least one trapezoidal housing groove 136 as well as the O-ring 134, the latter residing in the separate O-ring groove 135.

FIG. 5 shows a partial cross-sectional view of an injection tool 139 clamped in position over the swagable high-pressure terminal connector 110 just prior to injection of dielectric enhancement fluid into the cable section 10, as further described below. In a typical assembly procedure using this embodiment, the insulation jacket 12 of cable section 10 is first prepared for accepting a termination crimp connector 131, as described in Publication No. US 2005/0191910. The housing 130 of the connector 110 includes an injection port 48 (see DETAIL 5B, FIG. 5B). As described above, the housing is sized such that its larger internal diameter (ID) at the first end portion of the housing is just slightly larger than the outer diameter (OD) of insulation jacket 12 and its smaller ID at an opposite second end portion is just slightly larger than the OD of the termination crimp connector 131. The housing 130 is slid over a conductor 14 of the cable section 10 and over the insulation jacket 12 of the cable section, and the termination crimp connector 131 is then slipped over the end of the conductor 14 and within the housing. The second end portion of the housing 130, having first O-ring 104 residing in a groove therein, is first swaged with respect to termination crimp connector 131 (i.e., a conductor member. This first swage is applied over the first O-ring 104 and the essentially square machined interior teeth 108 of the second end of the housing 130. Swaging can be performed in a single operation to produce swaging together of the conductor 14 and the termination crimp connector 131, and swaging together of the housing 130 and the termination crimp connector 131. Alternatively, swaging can be performed in phases (wherein the termination crimp connector 131 is swaged together with conductor 14 before the housing 130 is swaged together with the resulting termination crimp connector/conductor combination. This swaging operation joins the conductor 14, the termination crimp connector 131, and the housing 130 in intimate mechanical, thermal and electrical union and provides a redundant seal to the O-ring 104 to give a fluid-tight seal between the housing 130 and the termination crimp connector 131. It is also possible to perform the swaging operation over the insulation before swaging over the conductor, but the above sequence is preferred.

In FIG. 5, a copper termination lug 133 is spin welded to the aluminum termination crimp connector 131 to provide a typical electrical connection. The swaged assembly is then (optionally) twisted to straighten the lay of the outer strands of the conductor 14 to facilitate fluid flow into and out of the strand interstices. A second swage is then applied to the exterior of the first end portion of the housing 130 over the second O-ring 134 (which resides in the separate interior groove 135 in the housing 130), the Acme thread-shaped grooves 138, and the trapezoidal groove 136 (i.e., over the insulation swaging region of DETAIL 5A of FIG. 5 and enlarged in FIG. 5A). The housing 130 can be machined from a 303 stainless steel and may be annealed after machining to limit susceptibility to work-hardening. O-rings 104 and 134 can be fabricated from ethylene-propylene rubber (EPR), ethylene-propylene diene monomer (EPDM) rubber or a fluoroelastomer such as Viton®. This swaging operation forces at least some polymer of insulation jacket 12 into the trapezoidal groove 136 and the Acme thread grooves 138, while simultaneously deforming O-ring 134 to the approximate shape depicted in FIG. 5A. As a result, a fluid-tight seal is formed between insulation jacket 12 and the first end portion of the housing 130, which seal prevents pushback of the insulation and provides leak-free operation when the cable section 10 contains fluid at elevated pressure and is subjected to substantial thermal cycling, as described above.

Figure 5B:
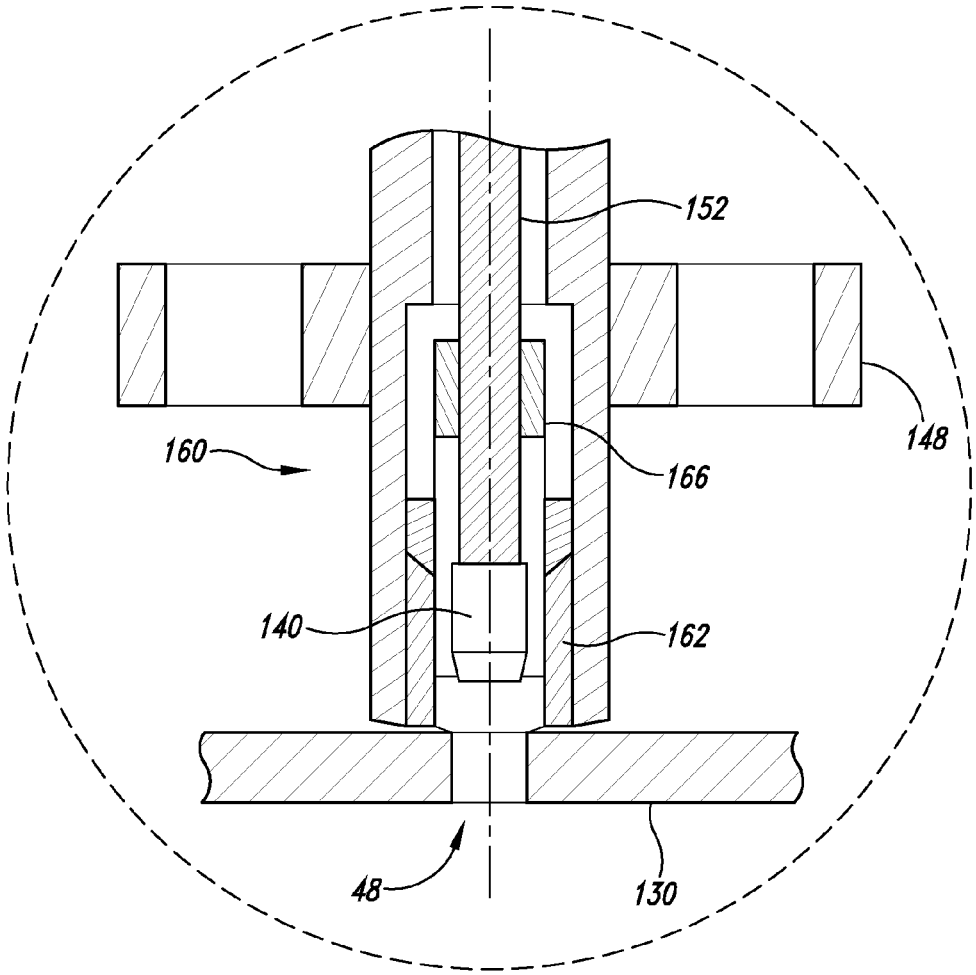
FIG. 5B is a cross-sectional view of detail area 5B of FIG. 5 showing the seal tube and injector tip.
Figure 5C:
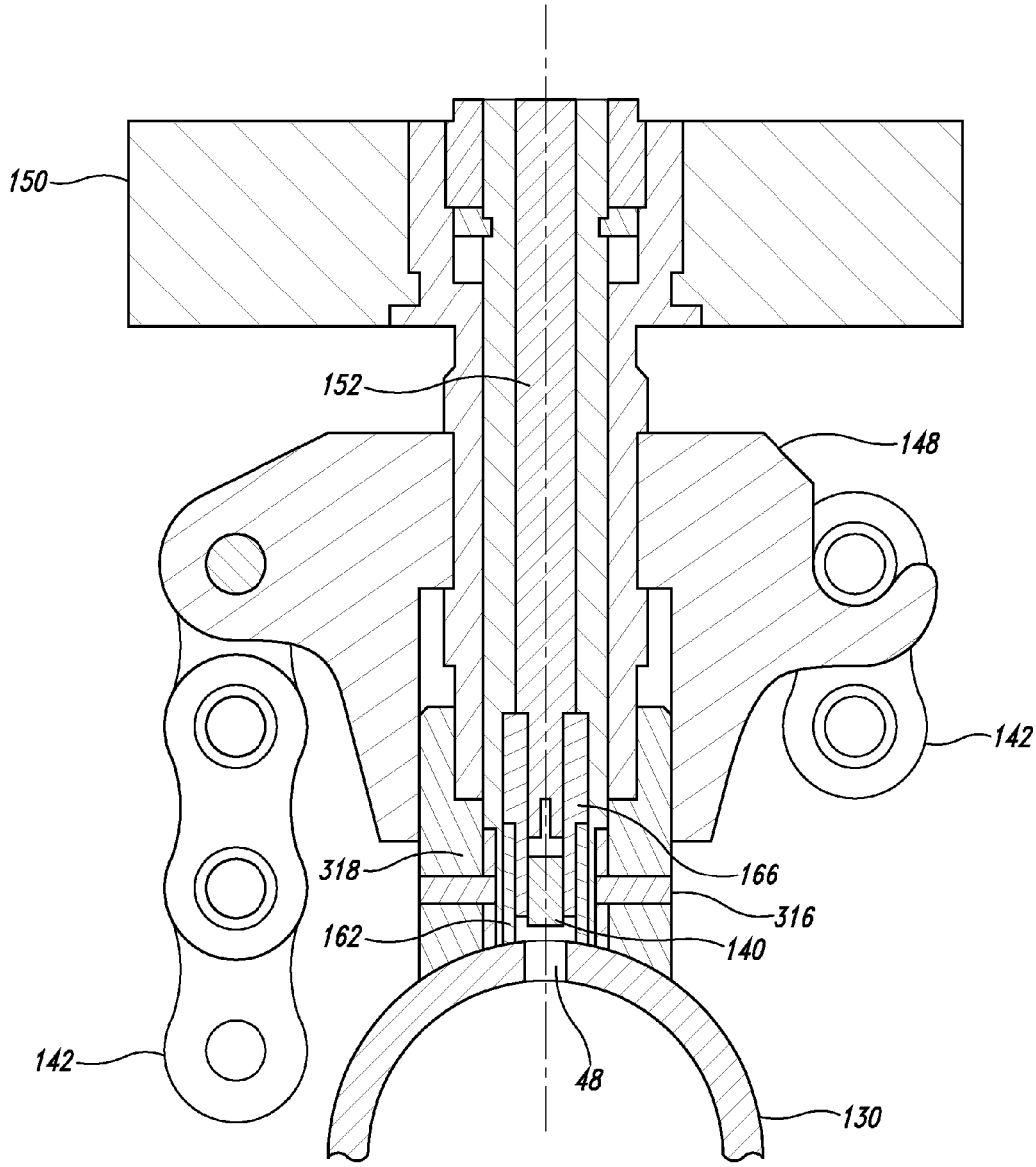
FIG. 5C is an enlarged cross-sectional view of the lower portion of the injection tool shown in FIG. 5 taken along the axial direction of the injection tool.
Figure 5D:
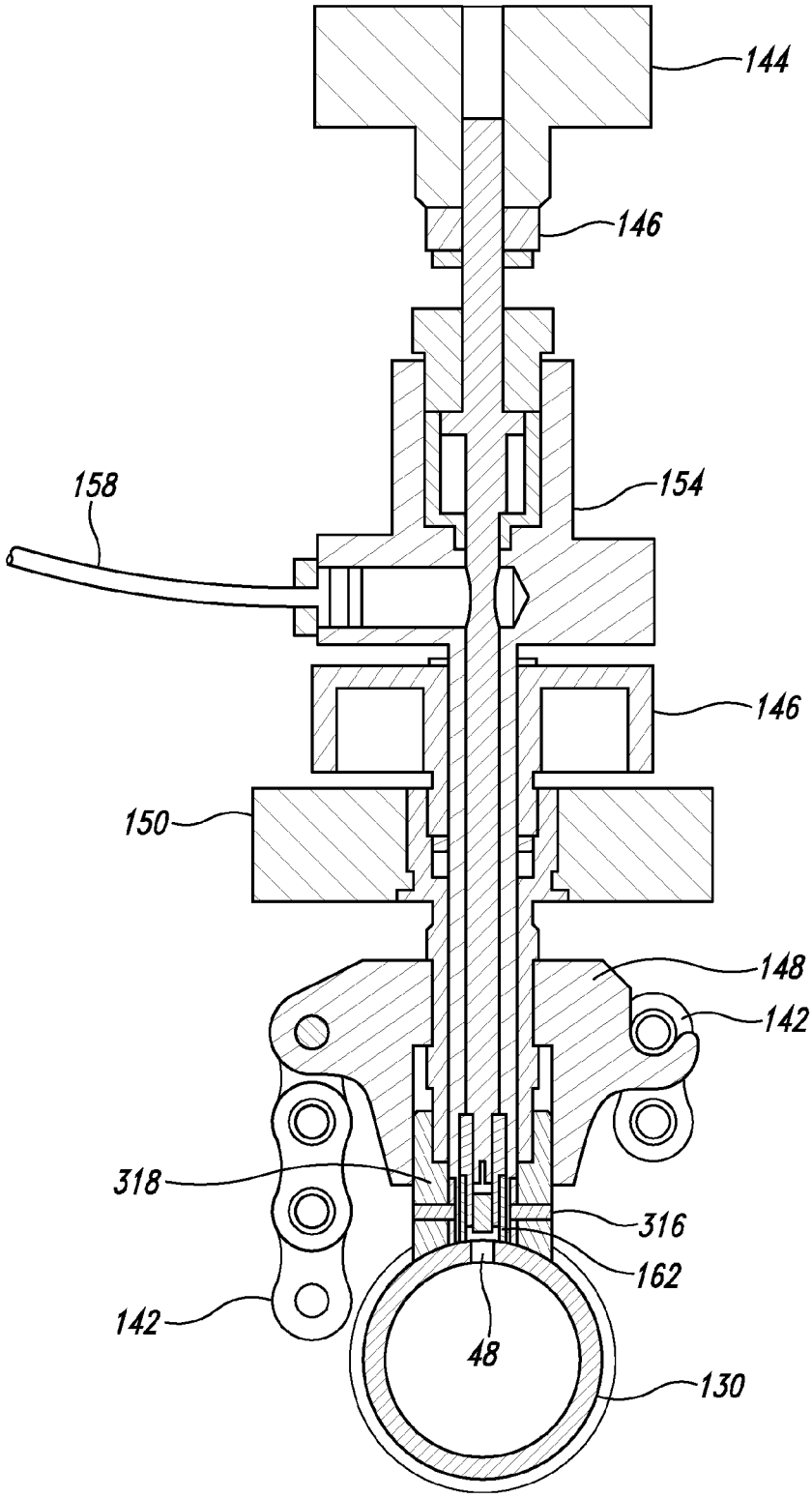
FIG. 5D is an enlarged cross-sectional view of the injection tool shown in FIG. 5 taken along the axial direction of the injection tool.

At this point, the swaged connector 110, and cable section 10 to which it is attached, is ready to be injected with a dielectric enhancement fluid at an elevated pressure. In a typical injection procedure, a plug pin 140, further described below, is loaded into a seal tube injector tip 160 of injection tool 139 such that it is held in place by spring collet 166, as shown in FIG. 5B. Spring collet 166 comprises a partially cutout cylinder that has two 180° opposing "fingers" (not shown) which grip plug pin 140 with sufficient force such that the latter is not dislodged by handling or fluid flow, but can be dislodged when the plug pin 140 is inserted into injection port 48, as shown in detail in FIG. 5B. The fluid to be injected, as further describe below, can flow between these "fingers" of spring collet 166. Referring to FIGS. 5 and 5B, yoke 148 is positioned over housing 130 and its center line is aligned with injection port 48 using a precision alignment pin (not shown), the latter being threaded into yoke 148. The precision alignment pin (not shown) brings the axis of clamp knob 150 and injection port 48 into precise alignment. Clamp chain 142, attached at one side to yoke 148, is wrapped around housing 130 and then again attached to a hook on the other side of yoke 148. The now loosely attached chain is tightened by turning clamp knob 150 (by means of threads-not shown). The precision alignment pin is unthreaded and removed from the yoke 148. Injection tool 139 is threaded into the yoke 148 and seal knob 146 is then threaded into clamp knob 150 to compress a polymeric seal 162 against the exterior of housing 130, the entire injection tool 139 now being in precise alignment with injection port 48. At this point there is a fluid-tight seal between the seal tube injector tip 160 and the housing 130, thereby providing a flow path (for fluid) through injection port 48 between the interior of the injection tool 139 and the interior of the housing 130, as shown in FIG. 5B. FIGS. 5C and 5D are enlarged cross-sectional views of the injection tool 139 shown in FIG. 5 along the axial direction of the injection tool. These figures shows slide block 318 which presses against the housing 130 with a force equal to twice the tension of chain 142. Guide pins 316 align with slots in the seal tube injector tip 160 and orient it with respect to housing 130 such that the axes of their respective curvatures are aligned, thus allowing a fluid tight seal to be made.

Figure 6:
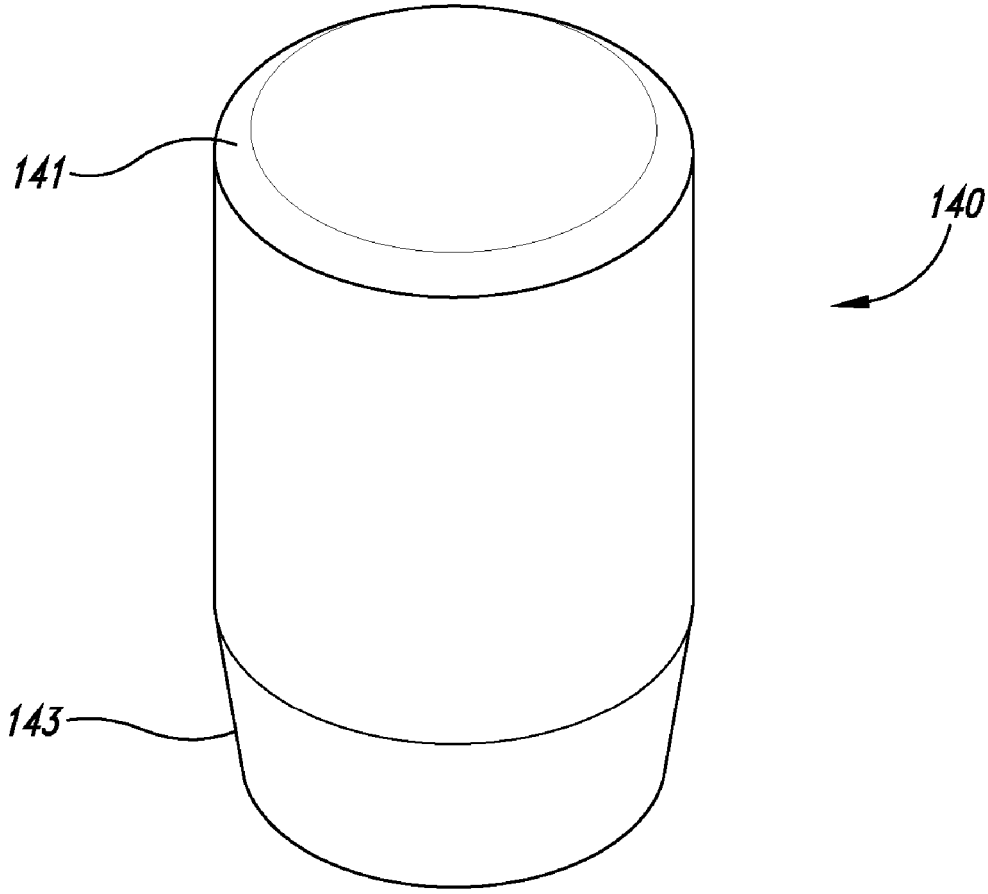
FIG. 6 is a perspective view of a plug pin used to seal the injection port of the connector shown in FIG. 5.

Pressurized fluid is then introduced to the interior of connector 110 and the interstitial void volume of cable section 10 via a tube 158, seal tube inlet 154 and an annulus (not shown)

formed between the seal tube injector tip 160 and the assembly of the press pin 152 and the plug pin 140. After the predetermined amount of fluid has been introduced (or a predetermined uniform pressure along the full length of the cable section has been attained, as described in detail in above cited Publication No. US 2005/0191910), a press pin actuator knob 144 is tightened (utilizing mated threads in the injection tool 139—not shown) so as to advance press pin 152 toward injection port 48, thereby pushing plug pin 140 into injection port 48 such that the nominally circular end surface of plug pin 140, located adjacent to a first chamfered end 141 of the plug pin, is essentially flush with the exterior surface of the housing 130. The first chamfered end 141 of the plug pin 140, illustrated in perspective view in FIG. 6, assures a post injection "no snag" exterior surface for the finished assembly of housing 130. The plug pin 140 has as a diameter slightly larger than the diameter of injection port 48 to provide a force fit therein. Finally, plug pin 140 also has a second chamfered end 143 to allow self-guidance into injection port 48 and to allow the force fit with injection port 48 to create a fluid-tight seal. At this point, the pressurized fluid supply is discontinued and injection tool 139 is disconnected from connector 110 to complete the injection process. Plug pin 140 can subsequently be pushed into the interior of the connector 110 in the event that additional fluid is to be injected or the system needs to be bled for any reason, and later a slightly larger plug pin can be re-inserted.

Figure 7:
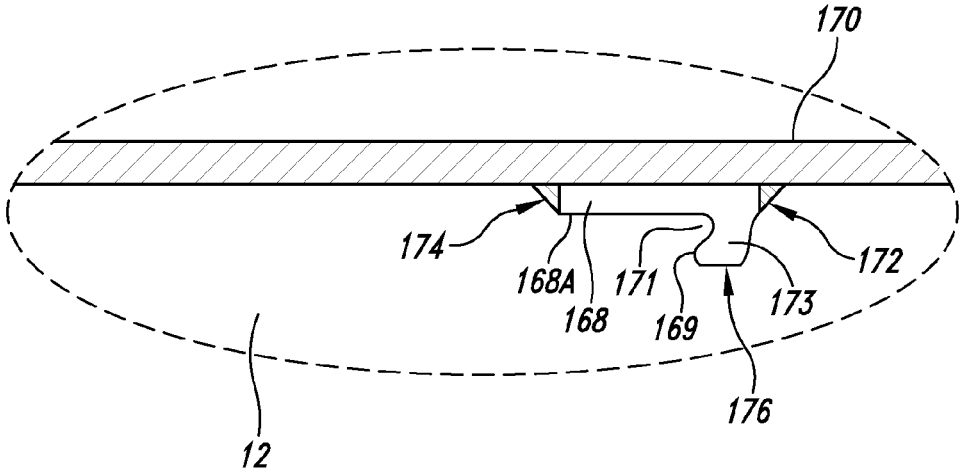
FIG. 7 is a cross-sectional view of one wall (top) of a connector housing which incorporates a ring having an axially-projecting circumferential spur.

In another embodiment shown in FIG. 7, at least one ring 168 having at least one axially-projecting circumferentially-extending spur 176 is located essentially at the inner wall of the housing 170 and positioned within the insulation swaging region. In the illustrated embodiment, the ring 168 is attached to the housing 170 by welds 172 and 174, and alternatively may be attached by brazing or soldering. The spur 176 has a generally radially outward facing wall 169 spaced radially inward from a radially inward facing wall portion 168A of the ring 168 to define a circumferentially-extending recess 171 therebetween. As described above for the recesses 218, the recess 171 forms an axially-opening undercut space located radially outward of the spur 176 within which a portion of the insulation jacket 12 of the cable section 10 is pressed and at least partially flows as a result of the swage applied to the exterior of the first end portion of the housing 170 in the insulation swaging region described above and the cable being placed in service. The ring 168 includes a generally radially inward projecting, circumferentially-extending base member 173 to support the spur 176.

Figure 7A:
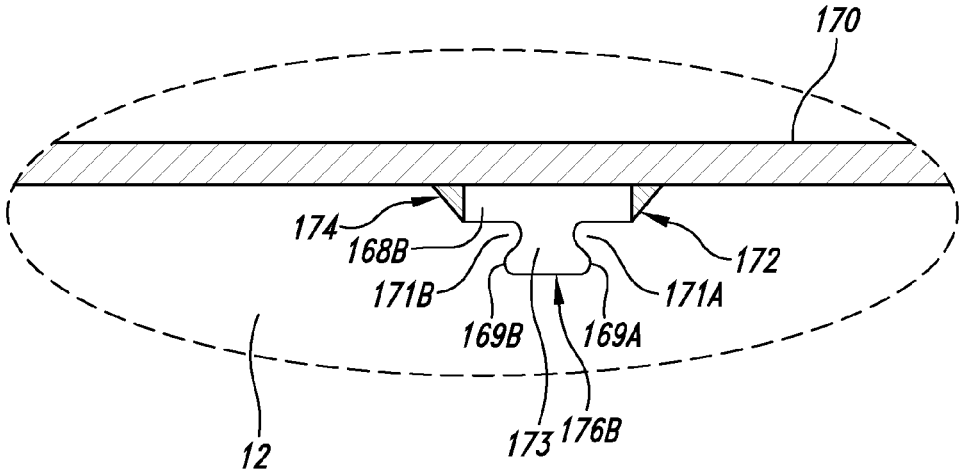
FIG. 7A is a cross-sectional view of one wall (top) of a connector housing which incorporates a ring having two axially-projecting circumferential spurs.

In this case, the cross-section of the ring 168 having the circumferentially-extending spur 176 has a single recess 171, however, the ring and spur may be formed with a second recess on the opposite side of the spur from the recess 171 illustrated in FIG. 7. The recesses of such a dual recess ring and spur arrangement may have two recesses which are symmetrical or have differing shapes, e.g., as shown in FIG. 7A and described below.

When the swaging operation over the insulation jacket is carried out, the spur 176 penetrates the insulation jacket by deforming and indenting the insulation jacket, and the polymer thereof flows around the spur and into the recess 171. The flow is facilitated by the increased temperature due to load on the cable when the latter is placed in service. This operation results in the formation of a generalized "mortise" indentation in the polymer of the insulation jacket and provides the above-referenced generalized "dovetail" union which resists radial separation between the housing and the insulation jacket during the cooling phase of a thermal cycle.

The spur 176 is made of a stiff material with sufficient rigidity to deform and indent the insulation jacket upon application of a radially inward force thereto applied during the swaging operation while maintaining the recess 171 with sufficient size such that the polymer of the insulation jacket that is positioned therein inhibits relative radial movement and separation of the insulation jacket and the housing. The spur 176, in effect, hooks the insulation jacket. In this embodiment, the ring 168 and the spur 176 thereof are made of a ductile metal, and the housing 170 is also made of the same ductile metal. In the "ring" embodiments of the spur described above as well as the "groove" embodiments formed into the wall of the housing as illustrated in FIGS. 5 and 5A and FIGS. 4A through 4E, the spur is made of the same material as the housing from which it is formed, which generally is a ductile (deformable) metal such as 300 series stainless steel that provides the spur with the same adequate stiffness to have sufficient rigidity to deform and indent the insulation jacket and maintain the correspondingly positioned recess as described above for the spur 176.

Alternatively, the ring 168 having the axially-projecting circumferentially-extending spur 176 may be attached to the inner wall of the housing 170 by swaging at the same time as the housing 170 is swaged to the insulation jacket. Further, a shallow groove (not shown) can be formed in the inner wall of the housing 170 to accept the ring, which can then be welded or otherwise attached to the inner wall of the housing. As in the case of the housing groove described above, the shape of the spur 176 is not critical provided that the recess 171 and the spur are disposed to provide at least one wall 169 of the spur adjacent to the recess which has an axial component which can resist radial retraction of the insulation jacket from the housing during the cooling portion of a thermal cycle. Thus, the spur 176 can have a cross-sectional profile and features similar to the profile of the spurs depicted in FIGS. 5 and 5A and FIGS. 4A through 4E, however, since the spur 176 is not formed in the wall of the housing, it can project radially inward more than the former spurs.

In a variation of the above described ring having an axially-projecting circumferentially-extending spur, the ring 168B shown in FIG. 7A can comprise a dual circumferential spur 176B with two spur portions that extend away from each other and recesses 171A and 171B on opposite sides of the base member 173. The dual spur 176B is disposed to provide two walls 169A and 169B of the spur, each adjacent to a corresponding one of the recesses 171A and 171B and having an axial component which can resist radial retraction of the insulation jacket from the housing during the cooling portion of a thermal cycle. Furthermore, as in the case of the previously described embodiments employing a housing groove geometry, it is contemplated herein that two or more rings having at least one axially-projecting circumferentially-extending spur may be included in the insulation swaging region of the housing.

Figure 8:
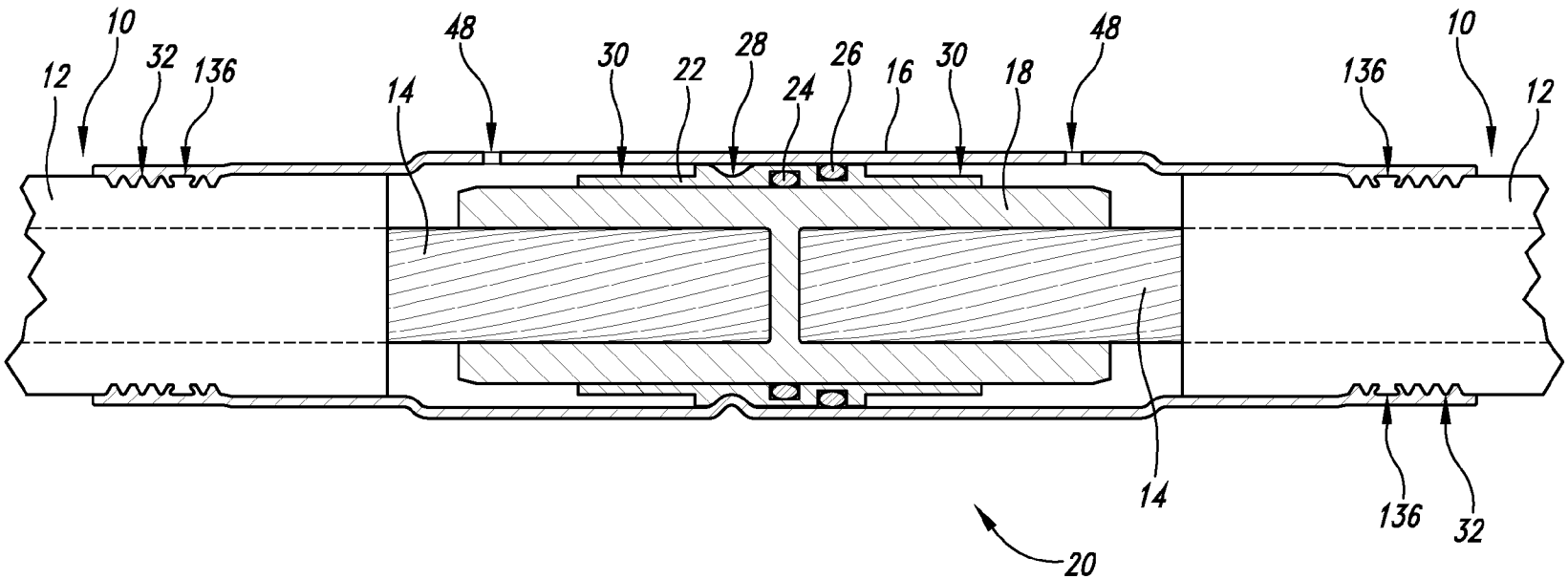
FIG. 8 is a partial cross-sectional view of a swagable high-pressure, single housing splice connector having circumferential machined teeth and trapezoidal grooves in the swaging regions.

The swagable high-pressure connectors described herein can have any of the swagable high-pressure terminal connector or splice connector configurations taught in above cited Publication No. US 2005/0191910, with the proviso that at least one axially-projecting circumferentially-extending spur is incorporated in the insulation swaging region of the housing thereof. Thus, for example, it can be a single-housing high-pressure swagable splice connector, as shown in FIG. 8. This connector is similar to the one shown in FIG. 1, wherein trapezoidal grooves 136 have been utilized and the spring-actuated valves 36 of FIG. 1 have been deleted to allow for a plug-pin closure, as described above. In a typical assembly procedure according to this embodiment, swagable highpressure splice connector 20 is used to connect two cable sections 10, these being referred to with respect to the figures herein as left and right cable sections. Each cable section 10 is first prepared for accepting splice crimp connector 18 (i.e., a conductor member) by cutting back the outermost layers of cable section 10, including the jacket when present (not shown), the neutral conductors (not shown) and the insulation shield (not shown), to accommodate cutback requirements per the component manufacture's recommendations. Similarly, the insulation jacket 12 and conductor shield (not shown) of cable section 10 is cut back to expose each stranded conductor 14 to the manufacturer's requirements.

Housing 16 is sized so that its ID (internal diameter) is just slightly larger than the OD (outer diameter) of insulation jacket 12 and is configured to receive the end portion of both cable sections 10 therein. Housing 16, having injection ports 48 for introduction of the restoration fluid, is slid over insulation jacket 12 to either the right or the left of the exposed strand conductors 14 to allow installation of the splice crimp connector 18 and bushing 22, as described below. Bushing 22, having an ID slightly larger than the OD of splice crimp connector 18 and OD slightly smaller than the ID of housing 16, is slid onto and centered on splice crimp connector 18 such that O-ring 24, which resides in a channel in bushing 22, is directly over the central non-crimped portion thereof. Bushing 22 includes a skirt 30 at both ends thereof which is simultaneously crimped during the crimping operation that joins splice crimp connector 18 to conductor 14 (i.e., the bushing, splice crimp connector and strand conductors are crimped together in one operation). This three-piece crimping brings conductor 14, splice crimp connector 18, and bushing 22 into intimate mechanical, thermal and electrical union and contact due to the respective deformations. The crimps joining bushing skirts 30, splice crimp connector 18 and conductor 14 can be of any variety well known in the art, such as two-point, hexagonal or other suitable means that assure that the ampacity of the connection meets the relevant standards and requirements of the connector manufacturer. O-ring 24, which is compressed by the tight fit over splice crimp connector 18, makes a fluid-tight seal between bushing 22 and splice crimp connector 18.

Housing 16 is then slid over insulation jacket 12 and centered over the bushing 22 and splice crimp connector 18. A crimp is made on the exterior of the housing 16 at a position measured from the center of housing 16 to be directly over a bushing indent 28 of the bushing 22. This assures that crimping occurs directly over bushing indent 28 to electrically, thermally, and mechanically join housing 16 and the bushing 22. An O-ring 26, residing in a channel in bushing 22, is sized to make a fluid tight seal between housing 16 and bushing 22. When the high-pressure splice connector of this embodiment is to be used to inject both cable sections simultaneously (e.g., in a flow-through mode), at least O-ring 26 is omitted and, preferably, both O-rings 24 and 26 are omitted. It should be noted that the central crimp over indent 28 is only made at one or more points (i.e., not a circumferential crimp or swage, which would restrict the flow rate of fluid past the bushing) to make a mechanical, electrical and thermal connection between splice crimp connector 18 and housing 16 through the bushing 22. Alternatively, bushing 22 could itself be eliminated and housing 16 crimped (i.e., multi-point crimped) directly to splice crimp connector 18 to provide the mechanical/electrical/thermal union and contact.

After housing 16 is placed in the position shown in FIG. 8, swages are applied to the periphery of the end portions of the housing 16 over circumferential teeth 32 and trapezoidal grooves 136. The end portions of the housing 16 are swaged to place them firmly and securely against the insulation jacket 12 with sufficient force that the teeth 32 and the spurs of the grooves 136 deform and partially penetrate each insulation jacket along a periphery thereof and also simultaneously form a fluid-tight seal with the insulation jacket, thus providing a seal resistant to thermal cycling and preventing pushback of the insulation jacket when one or both of the cable sections are subjected to sustained interior pressure. The circumferential wall end portion of the housing 16, at least in the periphery of the housing in the insulation swaging area, is made of a deformable material to allow inward swaging thereof onto the insulation jacket 12 of the cable section therein and subsequent grasping of the cable section sufficient to longitudinally immobilize the insulation jacket with respect to the housing during introduction of the fluid into the injection port and while the fluid is confined in the housing interior chamber at the residual pressure, and to produce fluid-tight engagement between the swaged deformable material and the insulation jacket.

At least one and preferably two injection ports 48 are employed to allow the injection of fluid at one end of each cable section and the withdrawal of water and contaminated fluid from the other, remote end of the respective cable section. Thus, each injection port may be utilized from either side (or both sides) of the splice crimp connector 20 to inject or withdraw fluid.

In the above, as well as other embodiments of the instant high-pressure splice connectors, it is preferred that the strands of the conductors 14 being joined by a crimping operation are first straightened to an orientation essentially parallel to the axis of the cable sections 10 to facilitate fluid flow into and out of the respective interstitial volume(s). Thus, in the above embodiment, the bushing/splice crimp connector combination 22/18 is first crimped to one conductor 14, such as the conductor of the left cable section 10, to be in mechanical, electrical and thermal integrity therewith. The bushing/splice crimp connector combination 22/18 is next rotated approximately 15 degrees to first straighten the original lay of the outermost layer of strands of that conductor, and then 15 more degrees, rotation being opposite to initial strand twist direction. The bushing/splice crimp connector combination 22/18 is next crimped to the conductor 14 of the right cable section 10. The bushing/splice crimp connector combination 22/18 is then rotated back (i.e., in the initial strand twist direction of the first conductor) approximately 15 degrees to straighten the lay of the outermost layer of the strands of the second conductor. Of course, the first conductor will also be rotated by this operation, thereby eliminating the counter lay of the left conductor and the original lay of the right conductor. All grease and dirt are cleaned from the straightened connectors prior to the crimping operations.

In the above embodiment, teeth 32 comprise a plurality of triangular circumferential grooves machined along the inner surface of housing 16 at each end thereof (i.e., the portions of the housing where swaging against insulation jacket 12 is to be applied). While the inside surface of the housing 16 of FIG. 8 is shown with machined teeth 32, for the purposes herein, the inside surface of housing 16 can be threaded, serrated, ribbed or even smooth, provided trapezoidal grooves 136 are included and the crimping operation deforms the housing 16 and insulation jacket 12 sufficiently to provide the aforementioned sealing and securing functions. This inside surface of housing 16 can also have undulating roughness or have inwardly directed tabs or protrusions, as will be described further below. Further, it is possible to introduce one or more rubber O-rings or another suitable elastomeric seal disposed between the insulation jacket 12 and the housing 16 inside surface, as shown in the embodiment of FIG. 9 described below, and to swage the housing at a peripheral surface adjacent to one or both sides of the O-ring, thereby providing a redundant sealing function.

Figure 9:
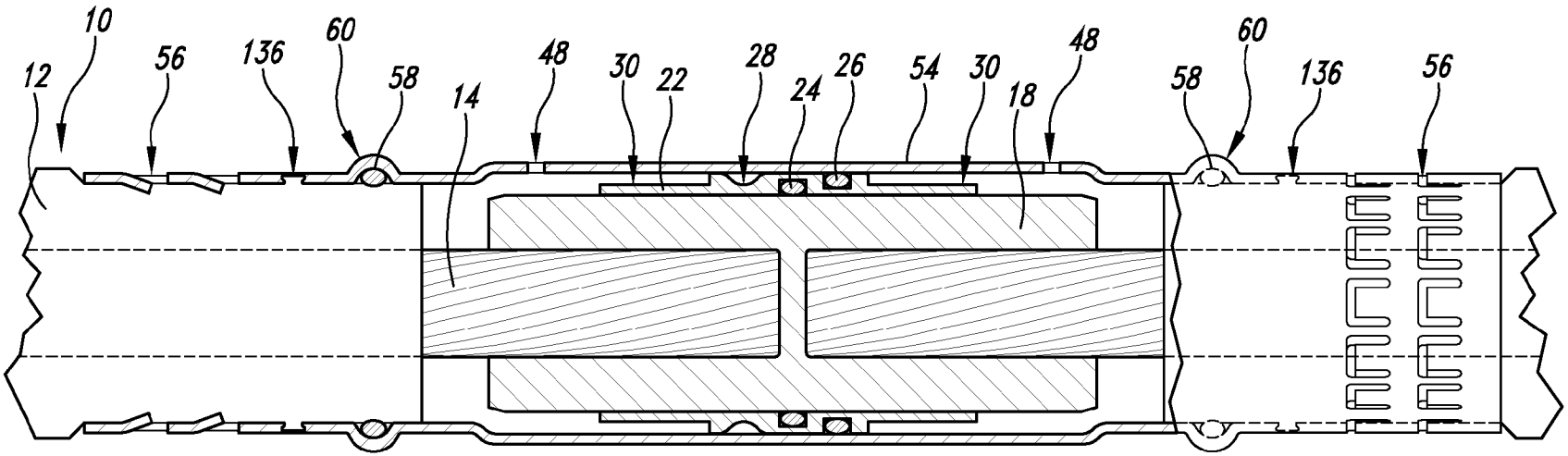
FIG. 9 is a partial cross-sectional view of a swagable high-pressure, single housing splice connector employing O-ring seals and having machined teeth and trapezoidal grooves in the swaging regions.

In another variation of the above swagable high-pressure splice connector, illustrated in FIG. 9, the machined teeth 32 of FIG. 8 have been replaced with a plurality of cut (e.g., milled or stamped) rectangular tabs 56, which are inwardly crimped to penetrate insulation jacket 12, provide the securing function and eliminate pushback. This is a variation of an ordinary point crimp and preferably employs a special tool to depress each tab 56 into the insulation jacket 12. Alternatively, tabs 56 can be swaged to provide the securing function as the softer plastic insulation will move through the grooves around each tab 56 providing a secure lock. Additional inward tab deflection can be accomplished during swaging to further improve the holding performance by a manufacturing process which leaves each tab 56 thicker on the outside diameter than the thickness of the housing 54. Of course, the shape of the above-described tabs can be adjusted (e.g., triangular, scalloped) to provide the necessary securing function. An O-ring 58 is positioned within a formed groove 60 of housing 54 to perform a redundant sealing function with the insulation jacket 12.

Figure 10:
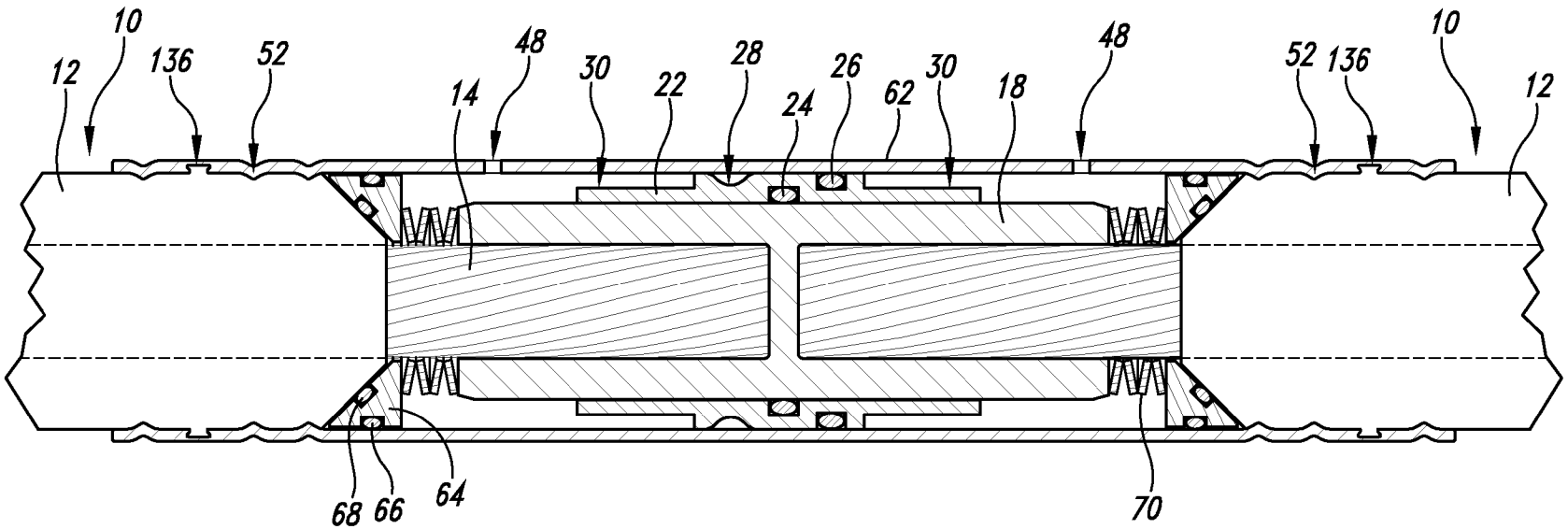
FIG. 10 is a partial cross-sectional view of a swagable high-pressure, single housing splice connector employing spring-actuated beveled axial O-ring seals and having circumferentially formed indentations and trapezoidal grooves in the swaging regions.

In another embodiment of the above swagable high-pressure splice connector, illustrated in FIG. 10, the teeth 32 of FIG. 8 have been replaced with swagable formed indentations 52 which restrain the insulation from push-back and act as a backup seal. In this case, the primary seal is a spring-actuated beveled metal washer 64 having at least one O-ring 66 to provide a fluid-tight seal with the inside surface of housing 62. Additionally, washer 64 has at least one O-ring 68 to provide a fluid-tight seal with a beveled end portion of insulation jacket 12, the O-rings being seated in corresponding grooves in beveled washer 64, as shown in FIG. 10. Beveling of the insulation jacket 12 may be accomplished with pencil-ing tools well known in the art and is performed as the last step in the preparation of the ends of cable sections 10.

In application, housing 62 of FIG. 10 is slid over insulation jacket 12 to either the right or the left, as described for the embodiment of FIG. 8. Beveled washer 64, along with its two preinstalled O-rings 66 and 68, is slid over the conductor 14 of each (i.e., right and left) cable section 10. Spring 70 is next slid over each conductor 14 and positioned against the beveled washers 64. Bushing 22, sized as previously described, is slid onto and centered on splice crimp connector 18 such that O-ring 24 is directly over the center non-crimped portion thereof. Just before a crimp is applied to each of the bushing skirts 30 of the bushing 22, the bushing 22 and splice crimp connector 18 are, as a unit, forced against the spring such that spring 70 is fully compressed when crimping is complete, thereby preloading O-ring 68 and providing for a thermally induced or mechanically induced movement of the beveled surface of insulation jacket 12 away from splice crimp connector 18 were the insulation jacket 12 to move longitudinally away therefrom. As recited above, when the high-pressure splice connector of this embodiment is to be used in a flow-through mode, at least one and preferably both O-rings 24 and 26 are omitted. As further described above, swages are applied to the exterior of housing 62 over formed indentations 52 and trapezoidal grooves 136 so as to form a fluid-tight seal as well as prevent pushback of the insulation jacket when the cable section(s) is/are pressurized.

Figure 11:
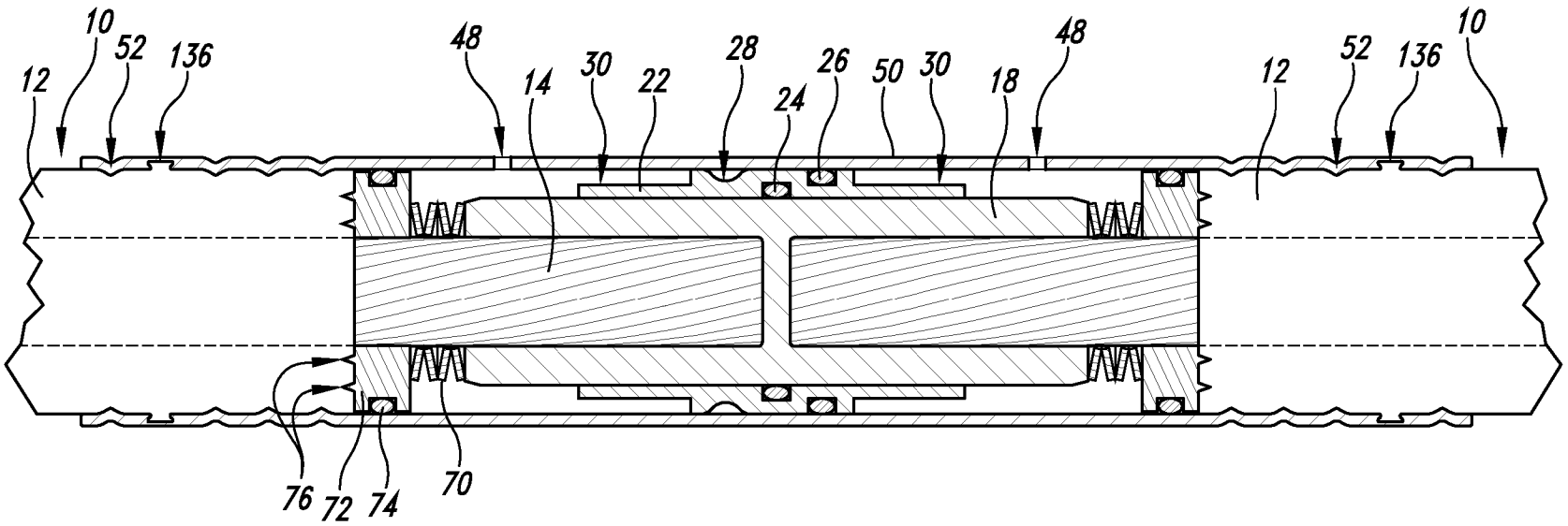
FIG. 11 is a partial cross-sectional view of a swagable high-pressure, single housing splice connector employing spring-actuated axial metal-to-plastic seals and having circumferentially formed indentations and trapezoidal grooves in the swaging regions.

In another embodiment of the above swagable high-pressure splice connector, illustrated in FIG. 11, beveled washer 64 and the O-ring 66 of FIG. 10 have been replaced with toothed washer 72 and associated O-ring 74. The toothed washer 72 has one or more axially projecting, concentrically arranged circular face teeth 76. The installation according to this embodiment proceeds in a manner similar to that described in connection with FIG. 10. In this case, sufficient axial force is applied to spring 70 and, in turn, washer 72 prior to crimping the bushing skirts 30 of the bushing 22 and splice crimp connector 18 to conductor 14 such that spring 70 is fully compressed and circular face tooth/teeth 76 is/are fully embedded into the end face of insulation jacket 12 to provide additional sealing function when the swaging over formed indentations 52 is complete.

Figure 12:
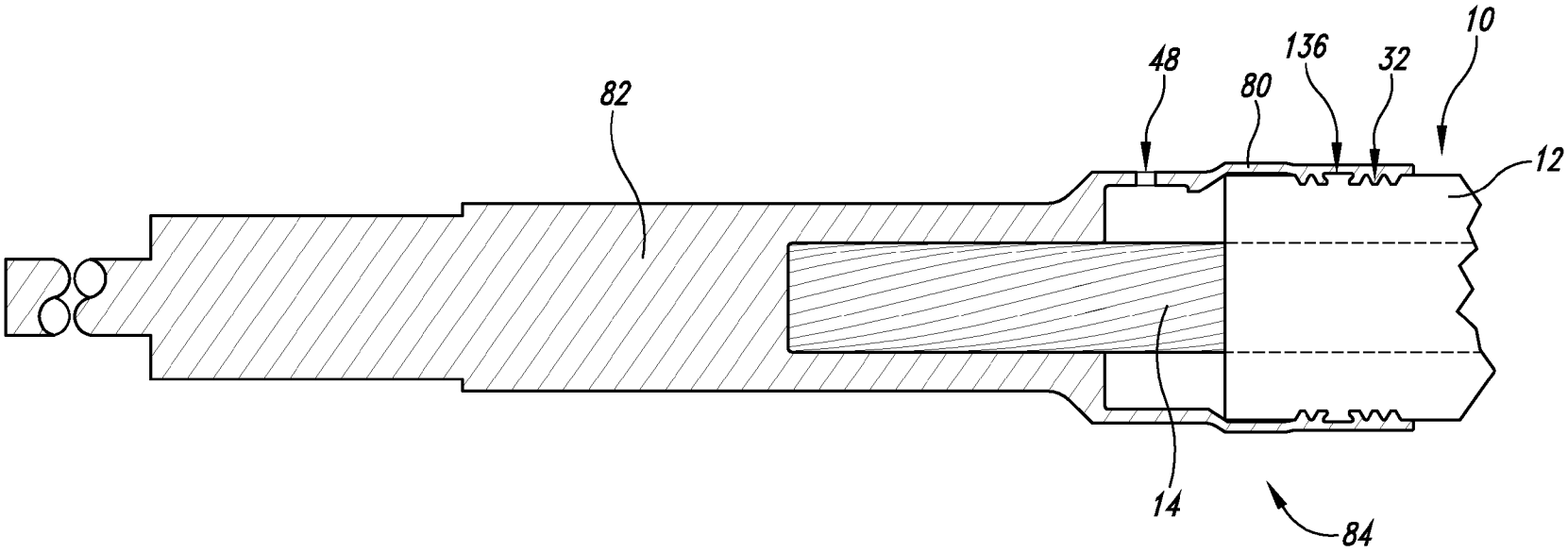
FIG. 12 is a partial cross-sectional view of a swagable high-pressure, integral housing terminal connector having machined teeth and a trapezoidal groove in the swaging regions.

Of course, those skilled in the art will recognize that any of the above swagable high-pressure splice connectors employing various sealing/securing means may be modified to provide a high-pressure terminal connector. For example, this may be accomplished by simply replacing the splice crimp connector with a termination crimp connector and forming a fluid-tight seal between the housing and the latter, the termination crimp connector also being secured to the housing. Furthermore, the termination crimp connector and the housing can be integral such that no additional seal is required between the housing and the termination crimp connector, as illustrated in FIG. 12. In this high-pressure terminal connector 84, a housing 80, having internal teeth 32, trapezoidal groove 136 and injection port 48, is integral with a termination crimp connector portion 82 thereof. In application, the termination crimp connector portion 82 is crimped to conductor 14 at an overlapping region to secure it thereto and provide electrical communication therewith. As in previous embodiments, housing 80 is swaged in the region of circumferential teeth 32 and trapezoidal groove 136 to provide the sealing and securing functions with respect to insulation jacket 12.

Figure 13:
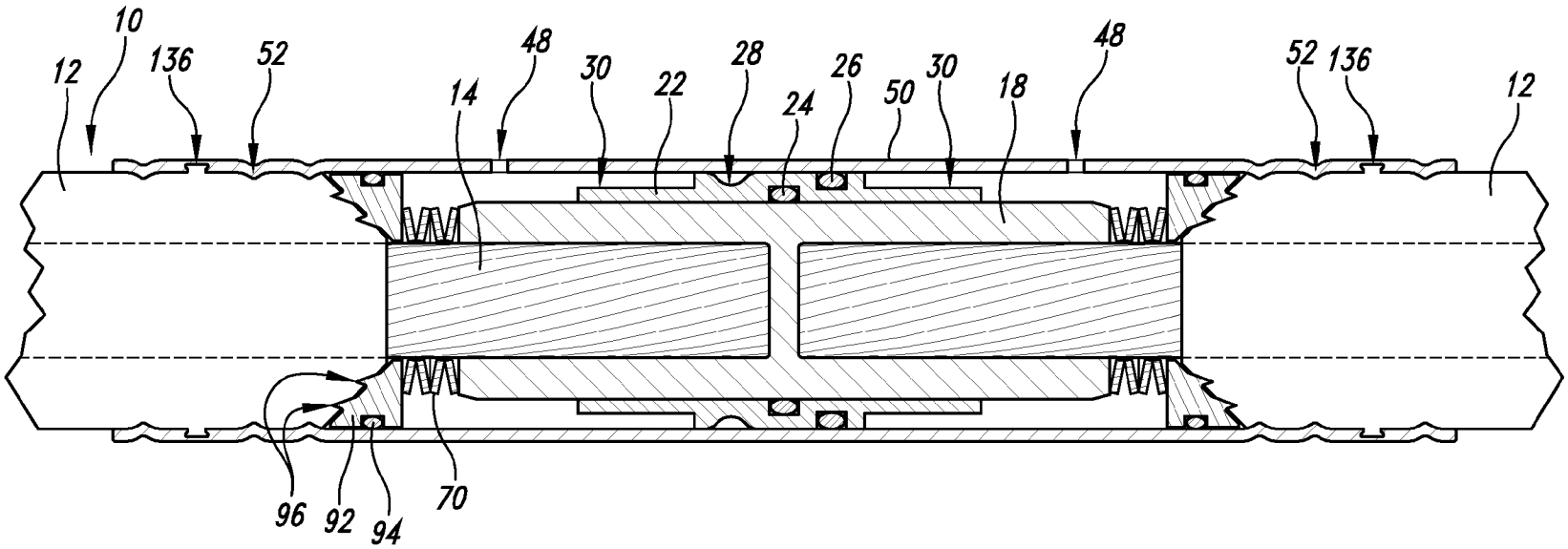
FIG. 13 is a partial cross-sectional view of a swagable high-pressure, single housing splice connector employing spring-actuated beveled axial metal-to-plastic seals and having circumferentially formed indentations and trapezoidal grooves in the swaging regions.

In another embodiment of a high-pressure swagable splice connector, illustrated in FIG. 13, beveled washer 64 of FIG. 10 has been replaced with toothed beveled washer 92 having one or more axially projecting, concentrically arranged circular face teeth 96 to provide the sealing function against a beveled end of insulation jacket 12 while O-ring 94 provides the seal against the interior of housing 50. It should also be understood that bushing 22 can be omitted in the single housing high-pressure splice connectors shown in FIGS. 8-11 and 13 provided the relative dimensions of the housing and splice crimp connector allows crimping (or swaging) of the former to the latter, again as taught in US 2005/0191910.

Figure 14:
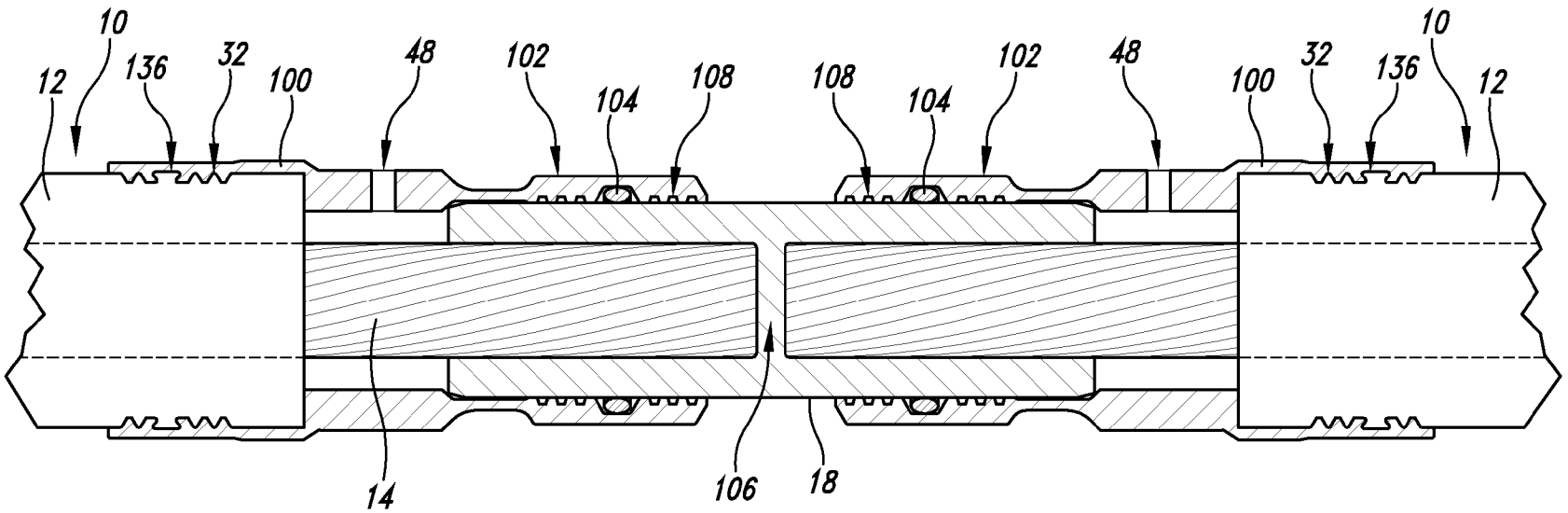
FIG. 14 is a partial cross-sectional view of a swagable high-pressure, dual-housing splice connector having machined teeth and trapezoidal grooves in the swaging regions.

In yet another embodiment, a dual-housing, swagable high-pressure splice connector, assembled from two identical swagable high-pressure terminal connectors of the type shown in FIG. 5, is illustrated in FIG. 14. In this case, housing 100, having O-ring 104 residing in a groove therein, is swaged with respect to splice crimp connector 18. The swage is applied at position 102 over the O-ring 104 and the machined teeth 108, which may have a profile varying from roughly triangular to roughly square. This swaging operation joins the conductor 14, splice crimp connector 18, and housing 100 in intimate mechanical, thermal and electrical union and contact and provides a redundant seal to the O-ring 104. When the splice according to the embodiment of FIG. 14 is to be used in a flow-through mode, water stop region 106 (i.e., a barrier wall within splice crimp connector 18) may be omitted or drilled out prior to assembly. A swage is then applied to the exterior of each housing 100 over machined teeth 32 and trapezoidal groove 136 such that the respective insulation jacket 12 is sufficiently deformed to provide a fluid tight seal and prevent pushback of the insulation when the cable sections are pressurized. The injection port 48 on housing 100 allows fluid to be injected or withdrawn at elevated pressures, as described above. Again, when the swagable high-pressure splice connector according to this embodiment is to be used in a flow-through mode, the injection ports may be omitted.

As will be apparent to those skilled in the art, the high-pressure splice connectors described herein are generally symmetrical with respect to a plane perpendicular to the cable axis and through the center of the splice crimp connector, and the assembly procedures described are generally applied to both ends of the splice. It also will be recognized that various combinations of the sealing and crimping options described herein for the different embodiments may be combined in "mix-and-match" fashion to provide the intended sealing and securing functions, although the skilled artisan will readily determine the more desirable and/or logical combinations. In general, the components of the instant connectors, except for any rubber (elastomeric) O-rings employed, are designed to withstand the anticipated pressures and temperatures and may be fabricated from a metal such as aluminum, aluminum alloy, copper, or stainless steel. Rubber washers and O-rings may be formed from any suitable elastomer compatible with the fluid(s) contemplated for injection as well as the maximum operating temperature of the connector. Preferred rubbers include fluorocarbon rubbers, ethylene-propylene rubbers, urethane rubbers and chlorinated polyolefins, the ultimate selection being a function of the solubility of, and chemical compatibility with, the fluid(s) used so as to minimize swell or degradation of any rubber component present.

Although only high-pressure terminal and splice connectors have been recited, it should be appreciated that the instant high-pressure connectors can also be used in tandem to form Y, T, or H electrical joints, described in US 2005/0191910.

It is further contemplated herein that the performance of the high-pressure connectors having any of the above described housing groove geometries can be further enhanced by adding an external seal, such as a shrink-in-place tube over the insulation jacket 12 at the housing/insulation jacket interface.

EXAMPLES

The following terminal high-pressure connectors having various housing sealing geometries with respect to the insulation jacket of a cable section were evaluated for leakage under substantial thermal cycling conditions. Each test connector employed comprised a housing having a threaded injection port 182 at one end thereof, as illustrated in cross-sectional view in FIG. 15, in this case the conductor shield 13 being shown. Five different housing sealing geometries were tested (shown in FIGS. 15, and 15A-15D), as follows:

(I) Acme thread-shaped grooves 138 in housing 180 (see FIG. 15 which uses a broken line to identify the insulation swaging region of the housing).

Figure 15A:
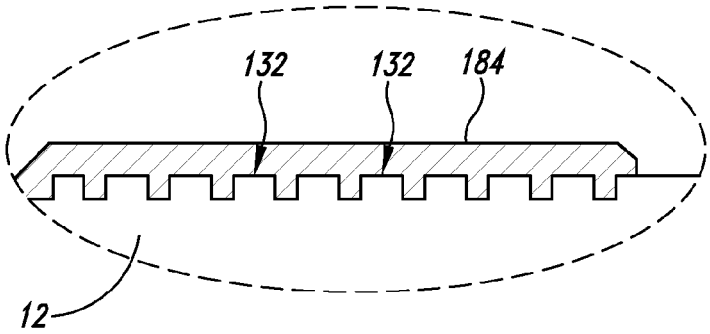
FIG. 15A is a detailed cross-sectional view of the housing wall (top) of a test connector similar to that shown in FIG. 8, in this case having square grooves in the insulation swaging region.

(II) Square grooves 132 in housing 184 (see FIG. 15A showing detail of the insulation swaging region).

Figure 15B:
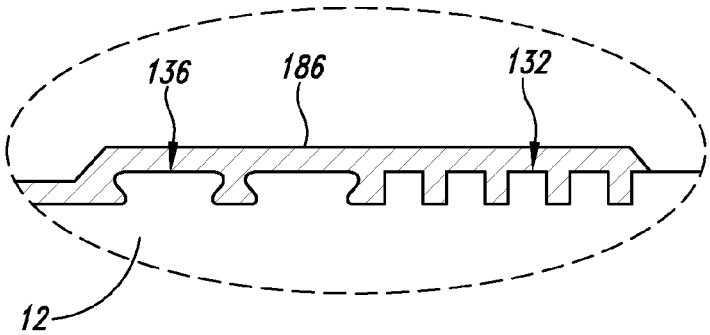
FIG. 15B is a detailed cross-sectional view of the housing wall (top) of a test connector similar to that shown in FIG. 8, in this case having trapezoidal as well as square grooves in the insulation swaging region.

(III) Trapezoidal grooves 136 in combination square grooves 132 in housing 186 (see FIG. 15B showing detail of the insulation swaging region) corresponding to the trapezoidal groove 136 illustrated in FIGS. 5 and 5A, described above.

Figure 15C:
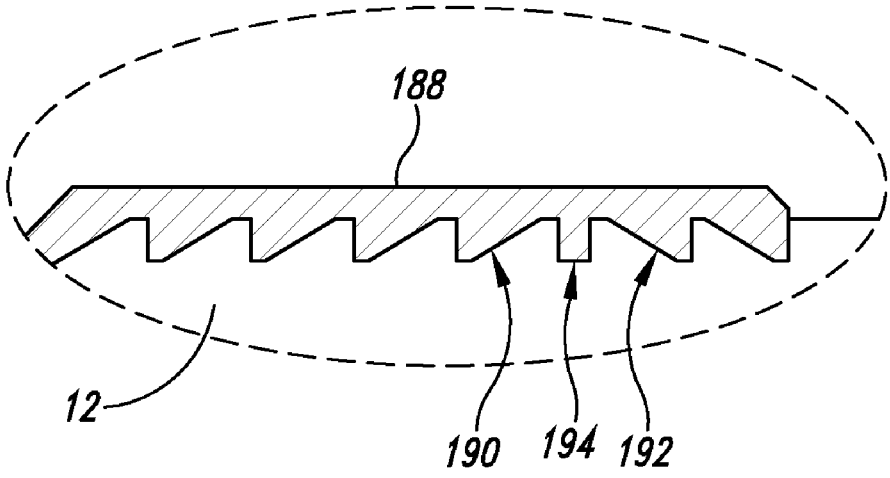
FIG. 15C is a detailed cross-sectional view of the housing wall (top) of a test connector similar to that shown in FIG. 8, in this case having buttress thread-shaped ridges angled in both axial directions in the insulation swaging region.

(IV) Buttress rib 194 formed from angled grooves 190 and 192 in housing 188 (see FIG. 15C showing detail of the insulation swaging region).

Figure 15D:
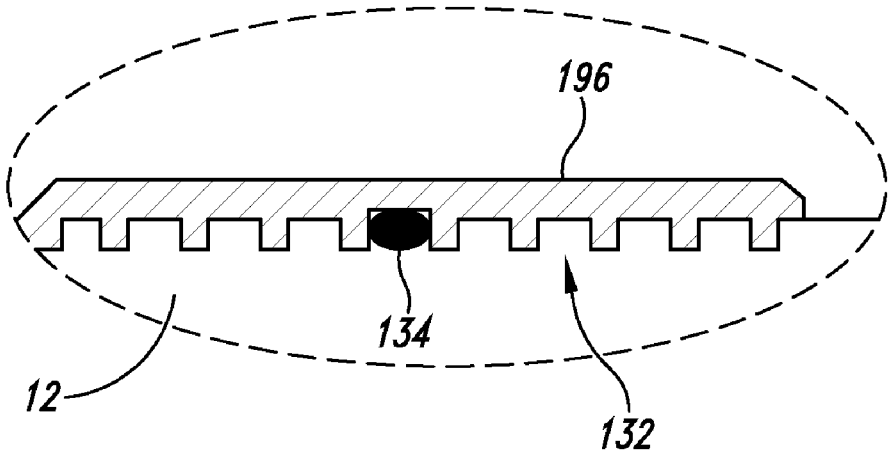
FIG. 15D is a detail cross-sectional view of the housing wall (top) of a test connector similar to that shown in FIG. 8, in this case having an O-ring as well as square grooves in the insulation swaging region.

(V) Circumferential O-ring 134 in combination with square grooves 132 in housing 196 (see FIG. 15D showing detail of the insulation swaging region). In this case, O-ring 134 resides in a square groove which is slightly deeper than square groove 132. In the above test connectors, each housing was fabricated from 304 stainless steel, annealed, and the O-ring was made of EPDM rubber. Each of the above described geometries (indicated in the first column of Table 2) was subjected to the pressure testing and accelerated aging protocols described below. Any leakage caused by thermal cycling was considered a component failure.

Figure 16:
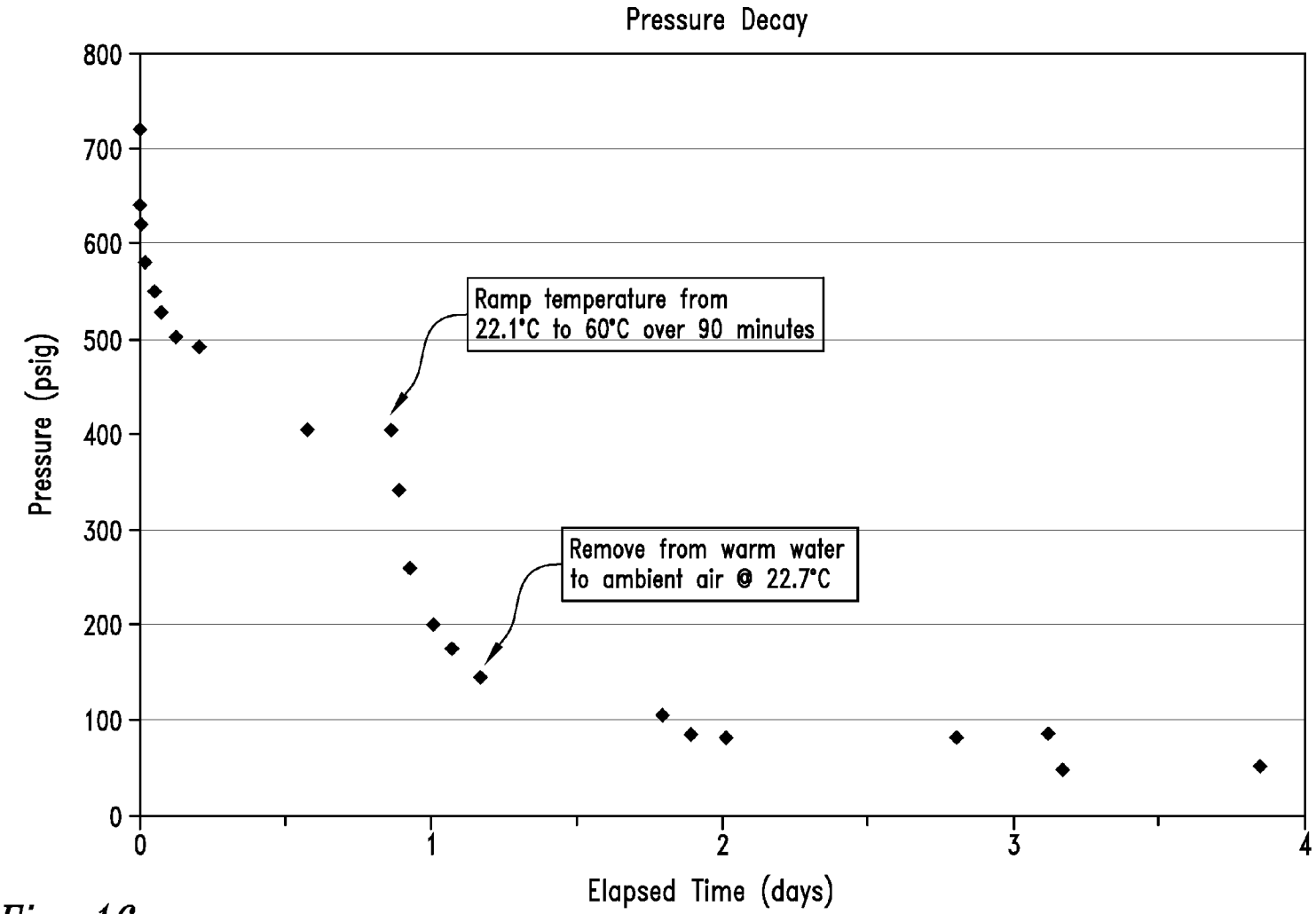
FIG. 16 shows a plot of pressure as a function of time during pressure testing of a typical test connector.

A first series of experiments was conducted in order to simulate the post injection high-pressure connector sealing performance during the phase wherein the pressure of the fluid in the cable and connector decays to a maximum head pressure of about 30 psig over a period of several days while the cable and connector are cycled from 60° C. to ambient (about 22° C.), as follows. A cable section was injected with a mixture of about 95%$_w$ of a polydimethylsiloxane fluid having a viscosity of 0.65 cS at 25° C. and about 5% w menthyl anthranilate at a pressure of 720 psig. The pump used to inject the above mixture was disconnected within minutes after this pressure was achieved throughout the test string. The test string included several 1/0 cable sections and high-pressure terminal connectors of different configurations in series. Leakage from the connectors was monitored throughout this test with the aid of UV light (menthyl anthranilate fluoresces bright green under UV illumination). The pressure was then allowed to decay for about 20 hours at an ambient temperature of about 22° C. The test sample assembly (a string of cable sections each with two connectors of each test geometry) was immersed in an ambient temperature, covered water bath and the temperature was increased over a period of approximately 90 minutes to about 60° C. When the water bath reached the nominal 60° C. target, heating was discontinued to allow the water to cool with the cover to the bath removed. After approximately 7 hours, the test string was removed from the water and the samples remained at ambient air temperature to the completion of the test. The pressure as a function of elapsed time from injection was recorded, as shown in FIG. 16, until the nominal residual pressure was about 50 psig. A final check was made for leaks approximately four days after pressurization and any remaining fluid in the cable sections and connectors was then drained and blown out with air. There were no leaks on any of the test samples, indicating that each design was adequate under such mild thermal cycling conditions.

Figure 17:
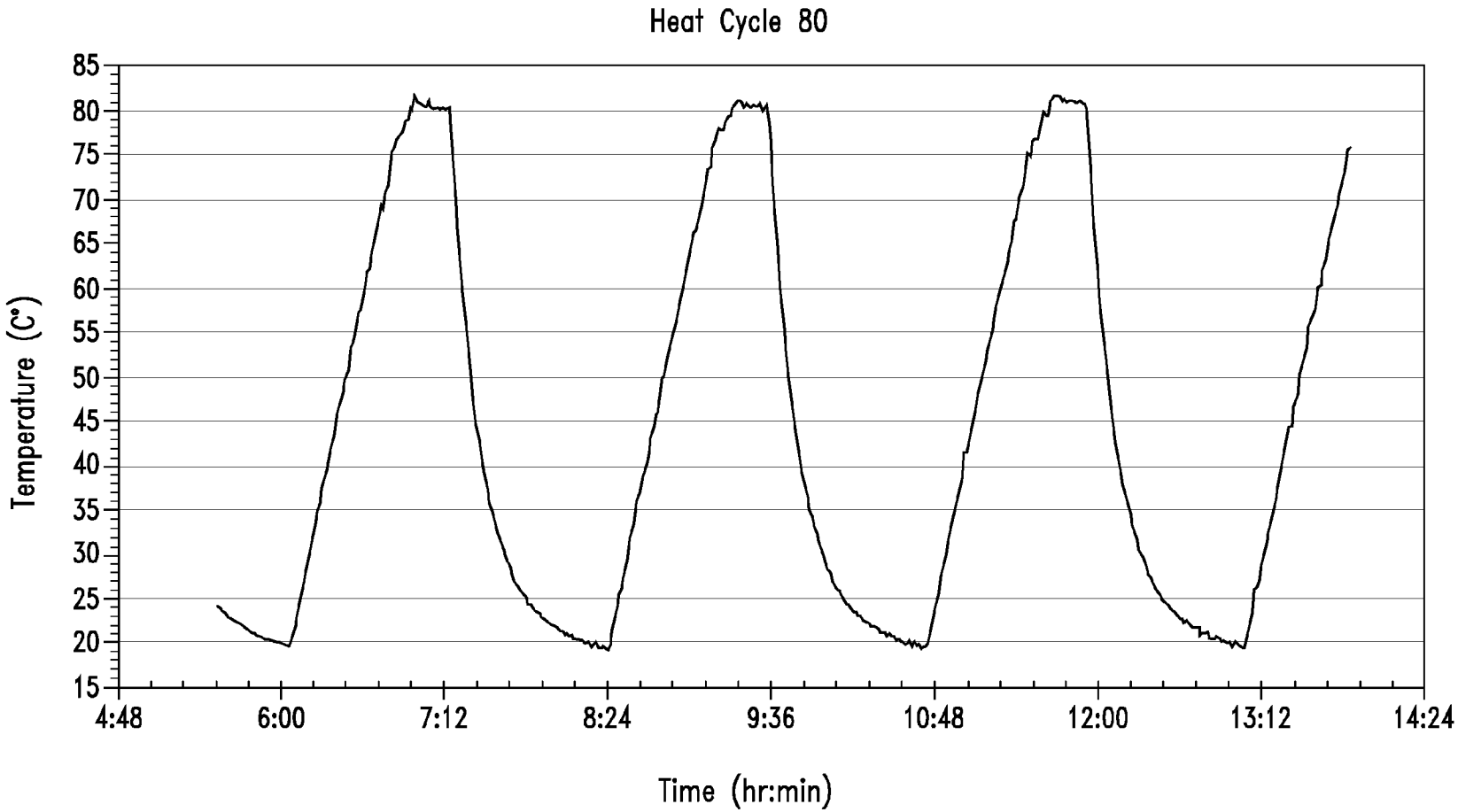
FIG. 17 is a plot of temperature as a function of time for a typical thermal cycling test.

A second series of experiments was conducted in order to simulate the post injection sealing performance during the phase wherein the fluid pressure has essentially decayed to a level representing only head pressure and the vapor pressure of the dielectric enhancement fluid and wherein this pressure level remains for a prolonged period (e.g., several years). For tests 1 through 13 described below the test assembly, including the connectors and attached cables, were pressurized to 30 psig with air to simulate approximately 60 feet of vertical head, or a lesser head and some fluid vapor pressure. For tests 14 and 15 the test assembly was pressurized to 60 psig with air to simulate approximately 60 feet of vertical head and 32 psig of fluid vapor pressure. The temperature was cycled repeatedly over an approximate nominal range of $\Delta T$=48° C. up to $\Delta T$=80° C. That is, the test assemblies including the connectors were cycled between a low temperature of about 19° C. and a high sample temperature ranging between 67° C. and 97° C., the upper temperature being raised in an incremental or escalating sequence, as delineated below. Thus, according to this test protocol, the cable section and attached connectors were pressurized with air at 30 psig and immersed in a room temperature water bath, about 20 to 22° C. The water temperature was cycled between (escalating) high temperatures ranging from 67° C. and 97° C. (in all cases +/−1° C.) and a low temperature of tap water at 15° C. to 22° C. with a cycle time of 160 to 110 minutes, such that the system went through about 9 to 13 complete temperature cycles each day. Three typical cycles of recorded temperature versus time are shown in FIG. 17. The sequence for 15 tests carried out according to the above protocol is summarized in Table 1. Results of these tests are presented in Table 2, wherein duplicate connectors of each design listed in the first column experienced all 15 tests unless both samples leaked, whereupon these two samples were removed.

TABLE 1

| Test No. | Description | Peak Temp. Range | Valley Temp. Range |
|---|---|---|---|
| 1 | 81 cycles to a high of 75° C. for 17 days, once to a maximum of 81° C. for one day. | 67 to 81° C., | 18 to 27° C. |
| 2 | 128 cycles to a high of 81° C., twice to 84° C., over a period of 12 days. | 80 to 84° C. | 18 to 22° C. |
| 3 | 8 additional cycles, over a period of 2 days. | 86 to 89° C. | 18 to 22° C. |
| 4 | Disassembled and reassembled test string to remove leaking sections with no additional heat cycles. | ambient | ambient |
| 5 | Second handling of connectors (same as 4). | ambient | ambient |
| 6 | Completely disassembled test string to check each section independently. (Tests 4, 5 and 6 were carried out in order to measure the outside diameter of the cable samples to determine whether there was any change due to the heat and pressure cycles). | ambient | ambient |
| 7 | 34 cycles over a period of 4 days. | 80 to 82° C. | 18 to 21° C. |
| 8 | 71 cycles over a period of 9 days | 80 to 82° C. | 18 to 21° C. |
| 9 | 222 cycles over a period of 22 days. | 80 to 85° C. | 18 to 21° C. |
| 10 | 63 cycles over a period of 7 days. | 86 to 89° C. | 18 to 20° C. |
| 11 | 71 cycles over a period of 8 days. | 89 to 90° C. | 17 to 20° C. |
| 12 | 45 cycles, one cycle to 95° C., over a period of 6 days. | 89 to 95° C. | 17 to 20° C. |
| 13 | 81 cycles, over a period of 14 days. | 87 to 90° C. | 15 to 19° C. |
| 14 | 56 cycles over a period of 10 days. | 88 to 91° C. | 14 to 17° C. |
| 15 | 66 cycles over a period of 7 days. | 93 to 97° C. | 13 to 15° C. |

Leaks were recorded, as indicated by bubbles in the water bath, and any leaking samples were removed from the experiment when both samples of a given design failed due to the thermal cycling. When only one of the duplicate samples failed, it was left in place and allowed to continue to leak or to "self-heal". With the exception of the circumferential O-ring geometry, at least one sample of each design leaked during at least one of the disassembly and handling steps (i.e., tests 4 to 6 in Table 1). However, some samples self-healed and did not leak when subjected to subsequent tests. Thus, for example, both trapezoidal geometry sampled parts leaked after test 6, but did not leak thereafter, as indicated by the blank cells of Table 2 for tests 7 through 15. The above tests were run to failure or for the time indicated.

TABLE 2

| Connector Geometry | Sealing Geometry | Sample No. | Test 1 | Test 2 | Test 3 | Test 7 | Test 8 | Test 9 | Test 10 | Test 11 | Test 12 | Test 13 | Test 14 | Test 15 |
|---|---|---|---|---|---|---|---|---|---|---|---|---|---|---|
| I | Acme thread | 1 | | | L | X | X | X | X | X | X | X | X | X |
| (FIG. 15) | | 2 | | | | X | X | X | X | X | X | X | X | X |
| II | Square | 1 | | L | L | X | X | X | X | X | X | X | X | X |
| (FIG. 15A) | | 2 | | | | X | X | X | X | X | X | X | X | X |
| III | Trapezoidal | 1 | | | | | | | | | | | | |
| (FIG. 15B) | | 2 | | | | | | | | | | | | |
| IV | Buttress Rib | 1 | | | | | | | | | L | X | X | X |
| (FIG. 15C) | | 2 | | | | | L | L | L | L | L | X | X | X |
| V | Circumferential | 1 | | | | | | | | L | L | X | X | X |
| (FIG. 15D) | O-Ring | 2 | | | | | | | | | L | X | X | X |

L = sample leaked

X = both samples removed from test after both leaked

From Table 2 it can be seen that only the trapezoidal geometry (III) provided a fluid-tight seal under all test conditions (as indicated by the blank cells). Moreover, these samples self-healed to provide leak-free operation even after the rough handling and partial disassembly of Tests 4 through 6.

That which is claimed is:

1. A high-pressure connector for an electrical power cable section having a central stranded conductor encased in a polymeric insulation jacket and having an interstitial void volume in the region of the stranded conductor, the high-pressure connector being suited for confining a fluid within the interstitial void volume at a residual pressure above atmospheric, but below the elastic limit of the polymeric insulation jacket, the high-pressure connector comprising:

a housing having a wall defining an interior chamber configured to be in fluid communication with the interstitial void volume, the housing having an end portion with the housing wall thereof sized to receive the insulation jacket within the interior chamber and to overlap at least a portion of the insulation jacket at an end thereof with the cable section extending from the housing end portion and at least a portion of the stranded conductor positioned within the interior chamber, the housing wall of the housing end portion having an engagement portion comprised of a swagable material to secure the housing wall to the insulation jacket in fluid-tight sealed engagement therewith upon inward swaging of the engagement portion of the housing wall of the housing end portion to the insulation jacket to confine the fluid at the residual pressure within the interior chamber and the interstitial void volume, the housing having at least one axially-projecting circumferential spur located within the interior chamber at the engagement portion of the housing wall of the housing end portion.

2. The connector of claim 1, wherein the spur is defined by a circumferential groove in the engagement portion of the housing wall of the housing end portion, the groove having a generally radially inward facing recessed wall portion, and the spur having a generally radially outward facing wall portion spaced radially inward from the radially inward facing recessed wall portion of the groove to define a circumferential recess therebetween within the groove to receive a portion of the insulation jacket to secure the housing wall to the insulation jacket.

3. The connector of claim 2, wherein the generally radially outward facing wall portion of the spur projects generally axially within the interior chamber, whereby the spur provides radial mating of the engagement portion of the housing wall of the housing end portion to the insulation jacket to resist radial separation therebetween after inward swaging of the engagement portion of the housing wall of the housing end portion to the insulation jacket.

4. The connector of claim 1, wherein the spur is a continuous member extending about the engagement portion of the housing wall of the housing end portion to provide a fluid-tight seal between the housing wall and the insulation jacket upon inward swaging of the engagement portion of the housing wall of the housing end portion to the insulation jacket.

5. The connector of claim 1, wherein the engagement portion of the housing wall of the housing end portion radially outward of the spur has a generally radially inward facing wall portion, and the spur has a generally radially outward facing wall portion spaced radially inward from the radially inward facing wall portion of the engagement portion to define a circumferential recess therebetween to receive a portion of the insulation jacket to secure the housing wall to the insulation jacket.

6. The connector of claim 5, wherein the generally radially outward facing wall portion of the spur projects generally axially within the interior chamber, whereby the spur provides radial mating of the engagement portion of the housing wall of the housing end portion to the insulation jacket to resist radial separation therebetween after inward swaging of the engagement portion of the housing wall of the housing end portion to the insulation jacket.

7. The connector of claim 5, wherein the spur is a continuous member extending about the engagement portion of the housing wall of the housing end portion to provide a fluid-tight seal between the housing wall and the insulation jacket upon inward swaging of the engagement portion of the housing wall of the housing end portion to the insulation jacket.

8. The connector of claim 1, further including a circumferential first member located within the interior chamber at the engagement portion of the housing wall of the housing end portion and spaced radially outward of the spur, and a circumferential second member connecting the circumferential first member and the spur together, the circumferential first member having a generally radially inward facing wall portion, the spur having a generally radially outward facing wall portion spaced radially inward from the radially inward facing wall portion of the first circumferential member, and the circumferential second member having a generally axially facing wall portion, the wall portions of the circumferential first member, the spur and the circumferential second member defining a circumferential recess therebetween to receive a portion of the insulation jacket to secure the housing wall to the insulation jacket.

9. The connector of claim 8, wherein the circumferential first member is attached to the engagement portion of the housing wall of the housing end portion.

10. The connector of claim 1, further including a circumferential member located within the interior chamber at the engagement portion of the housing wall of the housing end portion, the circumferential member having a generally radially inward facing wall portion spaced radially outward of the spur and a circumferential connection portion connected to and supporting the spur, the spur having a generally radially outward facing wall portion spaced radially inward from the radially inward facing wall portion of the circumferential member to define a circumferential recess therebetween to receive a portion of the insulation jacket to secure the housing wall to the insulation jacket.

11. The connector of claim 10, wherein the circumferential member is attached to the engagement portion of the housing wall of the housing end portion.

12. The connector of claim 11, wherein the generally radially outward facing wall portion of the spur projects generally axially within the interior chamber, whereby the spur provides radial mating of the engagement portion of the housing wall of the housing end portion to the insulation jacket to resist radial separation therebetween after inward swaging of the engagement portion of the housing wall of the housing end portion to the insulation jacket.

13. The connector of claim 10, wherein the spur is a continuous member extending about the engagement portion of the housing wall of the housing end portion to provide a fluid-tight seal between the housing wall and the insulation jacket upon inward swaging of the engagement portion of the housing wall of the housing end portion to the insulation jacket.

14. A highpressure connector for an electrical power cable section having a central stranded conductor encased in a polymeric insulation jacket and having an interstitial void volume in the region of the stranded conductor, the hiqhpressure connector being suited for confining a fluid within the interstitial void volume at a residual pressure above atmospheric, but below the elastc limit of the a polymeric insulation jacket, the high-pressure connector comprising:

a housing having a wall defining an interior chamber configured to be in fluid communication with the interstitial void volume, the housing having an end portion with the housing wall thereof sized to receive the insulation jacket within the interior chamber and to overlap at least a portion of the insulation jacket at an end thereof with the cable section extending from the housing end portion and at least a portion of the stranded conductor positioned within the interior chamber, the housing wall of the housing end portion haing an engagement portion comprised of a swagable material to secure the housing wall to the insulation jacket in fluid-tight sealed engagement therewith upon inward swaging of the engagement portion of the housing wall of the housing end porton to the insulation jacket to confine the fluid at the residual pressure within the interior chamber and the interstitial void volume, the housing having at least one axially-projecting circumferential spur located within the interior chamber at the engagement portion of the housing wall of the housing end portion, wherein the engagement portion of the housing wall of the housing end portion further includes inwardly projecting engagement members configured to deform and partially penetrate the insulation jacket along a periphery thereof to secure the housing wall to the insulation jacket.

15. The connector of claim 1, further including a conductor member configured to be secured to the housing, and to be secured to the stranded conductor and in electrical contact therewith.

16. The connector of claim 15, wherein the housing and the conductor member are a unitary member.

17. The connector of claim 16, wherein the conductor member has a wall defining an interior member chamber with an open end, the interior member chamber being sized to receive the stranded conductor therein and the member wall being of a crimpable material to secure the conductor member to the stranded conductor in electrical contact therewith upon inward crimping of the member wall.

18. The connector of claim 15, wherein the conductor member is a terminal crimp connector.

19. The connector of claim 15, wherein the conductor member is a splice crimp connector.

20. The connector of claim 15, wherein the conductor member is configured to be positioned within the interior chamber.

21. The connector of claim 20, wherein the conductor member is configured to be in fluid-tight sealed engagement with the housing.

22. The connector of claim 21, wherein the conductor member has a wall defining an interior member chamber with an open end, the interior member chamber being sized to receive the stranded conductor therein and the member wall being of a crimpable material to secure the conductor member to the stranded conductor in electrical contact therewith upon inward crimping of the member wall.

23. A high-pressure connector for an electrical power cable section having a central stranded conductor encased in a polymeric insulation jacket and having an interstitial void volume in the region of the stranded conductor, the high-pressure connector being suited for confining a fluid within the interstitial void volume at a residual pressure above atmospheric but below the elastic limit at the polymeric insulation jacket, the high-pressure connector comprising:

a housing having a wall defining an interior chamber configured to be in fluid communication with the interstitial void volume, the housing having an end portion with the housing wall thereof sized to receive the insulation jacket within the interior chamber and to overlap at least a portion of the insulation jacket at an end thereof with the cable section extending from the housing end portion and at least a portion of the stranded conductor positioned within the interior chamber, the housing wall of the housing end portion having an engagement portion comprised of a swagable material to secure the housing wall to the insulation jacket in fluid-tight sealed engagement therewith upon inward swaging of the engagement portion of the housing wall of the housing end portion to the insulation jacket to confine the fluid at the residual pressure within the interior chamber and the interstitial void volume, the housing having at least one axially-projectng circumferential spur located within the interior chamber at the engagement portion of the housing wall of the housing end portion, wherein the housing includes at least one injection port in fluid communication with the interior chamber and configured to introduce the fluid into the interior chamber.

24. A high-pressure connector for an electrical power cable section having a central stranded conductor encased in a polymeric insulation jacket and having an interstitial void volume in the region of the stranded conductor, the high-pressure connector being suited for confining a fluid within the interstitial void volume at a residual pressure above atmospheric, but below the elastic limit of the polymeric insulation jacket, the high-pressure connector comprising:

a housing having a wall defining an interior chamber configured to be in fluid communication with the interstitial void volume, the housing having an end portion with the housing wall thereof sized to receive the insulation jacket within the interior chamber and to overlap at least a portion of the insulation jacket at an end thereof with the cable section extending from the housing end portion and at least a portion of the stranded conductor positioned within the interior chamber, the housing wall of the housing end portion having an engagement portion comprised of an inwardly deformable material to secure the housing wall to the insulation jacket in fluid-tight sealed engagement therewith upon inward deformation of the engagement portion of the housing wall of the housing end portion to the insulation jacket to confine the fluid at the residual pressure within the interior chamber and the interstitial void volume, the housing having at least one axially-projecting engagement member located within the interior chamber at the engagement portion of the housing wall of the housing end portion.

25. The connector of claim 24, wherein the engagement portion of the housing wall of the housing end portion has a generally radially inward facing wall portion, and the engagement member has a generally radially outward facing wall portion spaced radially inward from the radially inward facing wall portion of the engagement portion to define a circumferential recess therebetween to receive a portion of the insulation jacket to secure the housing wall to the insulation jacket.

26. The connector of claim 25, wherein the generally radially outward facing wall portion of the engagement member projects generally axially within the interior chamber to provide radial mating of the engagement portion of the housing wall of the housing end portion to the insulation jacket to resist radial separation therebetween after inward deformation of the engagement portion of the housing wall of the housing end portion to the insulation jacket.

27. The connector of claim 24, wherein the engagement member is a continuous member extending about the engagement portion of the housing wall of the housing end portion and provides a fluid-tight seal between the housing wall and the insulation jacket upon inward deformation of the engagement portion of the housing wall of the housing end portion to the insulation jacket.

28. The connector of claim 24, wherein the engagement portion of the housing wall of the housing end portion radially outward of the engagement member has a generally radially inward facing wall portion, and the engagement member has a generally radially outward facing wall portion spaced radially inward from the radially inward facing wall portion of the engagement portion to define a circumferential recess therebetween sized to receive a portion of the insulation jacket to secure the housing wall to the insulation jacket.

29. The connector of claim 24, further including a circumferential first member located within the interior chamber at the engagement portion of the housing wall of the housing end portion and spaced radially outward of the engagement member, and a circumferential second member connecting the circumferential first member and the engagement member together, the circumferential first member having a generally radially inward facing wall portion, the engagement member having a generally radially outward facing wall portion spaced radially inward from the radially inward facing wall portion of the first circumferential member, the wall portions of the circumferential first member and engagement member defining a circumferential recess therebetween to receive a portion of the insulation jacket to secure the housing wall to the insulation jacket.

30. The connector of claim 24, further including a conductor member configured to be positioned within the interior chamber and configured to be secured to the housing and secured to the stranded conductor and in electrical contact therewith.

31. The connector of claim 30, wherein the conductor member is configured to be in fluid-tight sealed engagement with the housing.

32. The connector of claim 31, wherein the conductor member has a wall defining an interior member chamber with an open end, the interior member chamber being sized to receive the stranded conductor therein and the member wall being of a crimpable material to secure the conductor member to the stranded conductor in electrical contact therewith upon inward crimping of the member wall.

33. The connector of claim 32, wherein the housing and the conductor member are a unitary member.

34. A high-pressure connector for an electrical power cable section having a central stranded conductor encased in a polymeric insulation jacket and having an interstitial void volume in the region of the stranded conductor, the high-pressure connector being suited for confining a fluid within the interstitial void volume at a residual pressure above atmospheric, but below the elastic limit of the polymeric insulation jacket, the high-pressure connector comprising:

a housing having a wall defining an interior chamber configured to be in fluid communication with the interstitial void volume, the housing having an end portion with the housing wall thereof sized to receive the insulation jacket within the interior chamber and to overlap at least a portion of the insulation jacket at an end thereof with the cable section extending from the housing end portion and at least a portion of the stranded conductor positioned within the interior chamber, the housing wall of the housing end portion having an engagement portion comprised of an inwardly deformable material to secure the housing wall to the insulation jacket in fluid-tight sealed engagement therewith upon inward deformation of the engagement portion of the housing wall of the housing end portion to the insulation jacket to confine the fluid at the residual pressure within the interior chamber and the interstitial void volume, the housing having at least one axially-projecting engagement member located within the interior chamber at the engagement portion of the housing wall of the housing end portion, wherein the housing includes at least one injection port in fluid communication with the interior chamber and configured to introduce the fluid into the interior chamber.

35. A high-pressure connector for an electrical power cable section having a central stranded conductor encased in a polymeric insulation jacket and having an interstitial void volume in the region of the stranded conductor, the high-pressure connector being suited for confining a fluid within the interstitial void volume at a residual pressure above atmospheric, but below the elastic limit of the polymeric insulation jacket, the high-pressure connector comprising:

a housing having a wall defining an interior chamber configured to be in fluid communication with the interstitial void volume, the housing having an end portion with the housing wall thereof sized to receive the insulation jacket within the interior chamber and to overlap at least a portion of the insulation jacket at an end thereof with the cable section extending from the housing end portion and at least a portion of the stranded conductor positioned within the interior chamber, the housing wall of the housing end portion having an engagement portion comprised of a swagable material to secure the housing wall to the insulation jacket in fluid-tight sealed engagement therewith upon inward swaging of the engagement portion of the housing wall of the housing end portion to the insulation jacket to confine the fluid at the residual pressure within the interior chamber and the interstitial void volume, the housing having at least first and second axially-projecting circumferential spurs located at the engagement portion of the housing wall of the housing end portion.

36. The connector of claim 35, wherein the first and second spurs are adjacent to each other.

37. The connector of claim 35, wherein the first and second spurs project in opposite axial directions toward each other.

38. The connector of claim 35, wherein the first and second spurs are axially spaced apart and project in opposite axial directions away from each other.

39. The connector of claim 35, wherein the first and second spurs are defined by a circumferential groove in the engagement portion of the housing wall of the housing end portion, the groove having a radially inward facing recessed wall portion, and the first and second spurs each having a generally radially outward facing wall portion spaced radially inward from the radially inward facing recessed wall portion of the groove to define a circumferential recess therebetween within the groove to receive a portion of the insulation jacket to secure the housing wall to the insulation jacket.

40. The connector of claim 39, wherein the groove has a generally trapezoidal cross-sectional shape with the first and second spurs projecting in opposite axial directions toward each other.

41. The connector of claim 39, wherein the first and second spurs are positioned at opposite axial end portions of the groove.

42. The connector of claim 39, wherein the generally radially outward facing wall portions of the first and second spurs project generally axially within the interior chamber, whereby the spur provides radial mating of the engagement portion of the housing wall of the housing end portion to the insulation jacket to resist radial separation therebetween after inward swaging of the engagement portion of the housing wall of the housing end portion to the insulation jacket.

43. A high-pressure connector for an electrical power cable section having a central stranded conductor encased in a polymeric insulation jacket and having an interstitial void volume in the region of the stranded conductor, the high-pressure connector being suited for confining a fluid within the interstitial void volume at a residual pressure above atmospheric, but below the elastic limit of the polymeric insulation jacket, the high-pressure connector comprising:

a housing having a wall defining an interior chamber configured to be in fluid commmunication with the interstitial void volume, the housing having an end portion with the housing wall thereof sized to receive the insulaton jacket within the interior chamber and to overlap at least a portion of the insulation jacket at an end thereof with the cable section extending from the housing end portion and at least a portion of the stranded conductor positioned within the interior chamber, the housing wall of the housing end portion having an engagement portion comprised of a swagable material to secure the housing wall to the insulation jacket in fluid-tight sealed engagement therewith upon inward swaging of the engagement portion of the housing wall of the housing end portion to the insulation jacket to confine the fluid at the residual pressure within the interior chamber and the interstitial void volume, the housing having at least first and second axially-projecting circumferential spurs located at the engagement portion of the housing wall of the housing end portion, wherein the first and second spurs are each continuous members extending about the engagement portion of the housing wall of the housing end portion to provide a fluid-tight seal between the housing wall and the insulation jacket upon inward swaging of the engagement portion of the housing wall of the housing end portion to the insulation jacket.

44. A high-pressure connector for an electrical power cable section having a central stranded conductor encased in a polymeric insulation jacket and having an interstitial void volume in the region of the stranded conductor, the highpressure connector being suited for confining a fluid within the interstitial void volume at a residual ressure above atmospheric, but below the elastic limit of the polymeric insulation jacket, the high-pressure connector comprising:

a housing having a wall defining an interior chamber configured to be in fluid communication with the interstitial void volume, the housing having an end portion with the housing wall thereof sized to receive the insulation jacket within the interior chamber and to overlap at least a portion of the insulation jacket at an end thereof with the cable section extending from the housing end portion and at least a portion of the stranded conductor positioned within the interior chamber, the housing wall of the housing end portion having an engagement portion comprised of a swagable material to secure the housing wall to the insulation jacket in fluid-tight sealed engagement therewith upon inward swaging at the engagement portion at the housing wall of the housing end portion to the insulation jacket to confine the fluid at the residual pressure within the interior chamber and the interstitial void volume the housing having at least first and second axially-projecting circumferential spurs located at the engagement portion of the housing wall of the housing end portion, wherein the first and second spurs are each continuous members extending about the engagement portion of the housing wall of the housing end portion to provide a fluid-tight seal between the housing wall and the insulation jacket upon inward swaging of the engagement portion of the housing wall of the housing end portion to the insulation jacket, the housing further including a circumferential first member located within the interior chamber at the engagement portion of the housing wall of the housing end portion and spaced radially outward of the first and second spurs, and a circumferential second member connecting the circumferential first member together with the first and second spurs, the circumferential first member having generally radially inward facing first and second wall portions, the first and second spurs each having a generally radially outward facing wall portion, the radially outward facing wall portion of the first spur being spaced radially inward from the radially inward facing first wall portion of the first circumferential member to define a circumferential first recess therebetween to receive a first portion of the insulation jacket to secure the housing wall to the insulation jacket, and the radially outward facing wall portion of the second spur being spaced radially inward from the radially inward facing second wall portion of the first circumferential member to define a circumferential second recess therebetween to receive a second portion of the insulation jacket to secure the housing wall to the insulation jackets.

45. The connector of claim 44, wherein the circumferential first member is attached to the engagement portion of the housing wall of the housing end portion.

46. A high-pressure connector for an electrical power cable section having a central stranded conductor encased in a polymeric insulation jacket and having an interstitial void volume in the region of the stranded conductor, the high-pressure connector being suited for confining a fluid within the interstitial void volume at a residual pressure above atmospheric, but below the elastic limit of the polymeric insulation jacket, the high-pressure connector comprising:

a housing having a wall defining an interior chamber configured to be in fluid communication with the interstitial void volume, the housing having an end portion with the housing wall thereof sized to receive the insulation jacket within the interior chamber and to overlap at least a portion of the insulation jacket at an end thereof with the cable section extending from the housing end portion and at least a portion of the stranded conductor positioned within the interior chamber, the housing wall of the housing end portion having an engagement portion comprised of a swagable material to secure the housing wall to the insulation jacket in fluid-tight sealed engagement therewith upon inward swaging of the engagement portion of the housing wall of the housing end portion to the insulation jacket to confine the fluid at the residual pressure within the interior chamber and the interstitial void volume, the housing having at least first and second axially-projecting circumferential spurs located at the engagement portion of the housing wall of the housing end portion, the housing further including a circumferential member located within the interior chamber at the engagement portion of the housing wall of the housing end portion and connected to and supporting the first and second spurs, the circumferential member having generally radially inward facing first and second wall portions, the first and second spurs each having a generally radially outward facing wall portion, the radially outward facing wall portion of the first spur being spaced radially inward from the radially inward facing first wall portion of the circumferential member to define a circumferential first recess therebetween to receive a first portion of the insulation jacket to secure the housing wall to the insulation jacket, and the radially outward facing wall portion of the second spur being spaced radially inward from the radially inward facing second wall portion of the circumferential member to define a circumferential second recess therebetween to receive a second portion of the insulation jacket to secure the housing wall to the insulation jacket.

47. The connector of claim 46, wherein the circumferential member is attached to the engagement portion of the housing wall of the housing end portion.

48. The connector of claim 46, wherein the generally radially outward facing wall portions of the first and second spurs project generally axially within the interior chamber, whereby the spur provides radial mating of the engagement portion of the housing wall of the housing end portion to the insulation jacket to resist radial separation therebetween after inward swaging of the engagement portion of the housing wall of the housing end portion to the insulation jacket.

49. The connector of claim 46, wherein the first and second spurs are each continuous members extending about the engagement portion of the housing wall of the housing end portion to provide a fluid-tight seal between the housing wall and the insulation jacket upon inward swaging of the engagement portion of the housing wall of the housing end portion to the insulation jacket.

50. The connector of claim 46, wherein the circumferential member includes a ring portion fixedly attached to the engagement portion of the housing wall of the housing end portion.

51. A high-pressure connector for an electrical power cable section having a central stranded conductor encased in an insulation jacket and having an interstitial void volume in the region of the stranded conductor, the high-pressure connector being suited for confining a fluid within the interstitial void volume at a residual pressure, the high-pressure connector comprising:

a housing having a wall defining an interior chamber, the housing having an end portion with the housing wall thereof sized to receive the insulation jacket within the interior chamber and to overlap at least a portion of the insulation jacket with at least a portion of the stranded conductor positioned within the interior chamber, the housing wall of the housing end portion having an engagement portion comprised of a swagable material to secure the housing wall to the insulation jacket in fluid-tight sealed engagement therewith upon inward swaging of the engagement portion of the housing wall of the housing end portion to the insulation jacket to confine the fluid at the residual pressure within the interior chamber and the interstitial void volume, the housing having at least one circumferential groove in the engagement portion of the housing wall of the housing end portion, said groove forming at least one axially-projecting circumferential spur within the interior chamber at the engagement portion of the housing wall of the housing end portion.

52. The connector of claim 51, wherein the groove has a generally radially inward facing recessed wall portion, and the spur has a generally radially outward facing wall portion spaced radially inward from the radially inward facing recessed wall portion of the groove to define a circumferential recess therebetween within the groove to receive a portion of the insulation jacket to secure the housing wall to the insulation jacket.

53. The connector of claim 52, wherein the generally radially outward facing wall portion of the spur projects generally axially within the interior chamber, whereby the spur provides radial mating of the engagement portion of the housing wall of the housing end portion to the insulation jacket to resist radial separation therebetween after inward swaging of the engagement portion of the housing wall of the housing end portion to the insulation jacket.

54. A high-pressure connector for an electrical power cable section having a central stranded conductor encased in a polymeric insulation jacket and having an interstitial void volume in the region of the stranded conductor, the high-pressure connector being suited for confining a fluid within the interstitial void volume at a residual pressure above atmospheric, but below the elastic limit of the polymeric insulation jacket, the high-pressure connector comprising:

a housing having a wall defining an interior chamber configured to be in fluid communication with the interstitial void volume, the housing having an end portion with the housing wall thereof sized to receive the insulation jacket within the interior chamber and to overlap at least a portion of the insulation jacket at an end thereof with the cable section extending from the housing end portion and at least a portion of the stranded conductor positioned within the interior chamber, the housing wall of the housing end portion having an engagement portion comprised of a swagable material to secure the housing wall to the insulation jacket in fluid-tight sealed engagement therewith upon inward swaging of the engagement portion of the housing wall of the housing end portion to the insulation jacket to confine the fluid at the residual pressure within the interior chamber and the interstitial void volume, the housing having at least one circumferential groove located within the interior chamber at the engagement portion of the housing wall of the housing end portion, said groove having at least one axial dimension Xm which is greater than axial dimension Xr, wherein Xm is the maximum groove axial dimension at a radius greater than r but less then R, Xr is the groove axial dimension at radius r, R is an outer radius of the housing, and r is a radially inward radial position within the interior chamber whereat the dimension Xr of the groove is less than the dimension Xm of the groove.

55. The connector of claim 54, wherein r is the inner radius of the housing.

56. A high-pressure connector for an electrical power cable section having a central stranded conductor encased in a polymeric insulation jacket and having an interstitial void volume in the region of the stranded conductor, the high-pressure connector being suited for confining a fluid within the interstitial void volume at a residual pressure above atmospheric, but below the elastic limit of the polymeric insulation jacket, the high-pressure connector comprising:

a housing having a wall defining an interior chamber configured to be in fluid communication with the interstitial void volume, the housing having an end portion with the housing wall thereof sized to receive the insulation jacket within the interior chamber and to overlap at least a portion of the insulation jacket at an end thereof with the cable section extending from the housing end portion and at least a portion of the stranded conductor positoned within the interior chamber, the housing wall of the housing end portion having an engagement portion comprised of a swagable material to secure the housing wall to the insulation jacket in fluid-tight sealed engagement therewith upon inward swaging of the engagement portion of the housing wall of the housing end portion to the insulation jacket to confine the fluid at the residual pressure within the interior chamber and the interstitial void volume, the housing having at least one circumferential roove located within the interior chamber at the engagement portion of the housing wall of the housing end portion, said groove having at least one axial dimension Xm which is greater than axial dimension Xr, wherein Xm is the maximum groove axial dimension at a radius greater than r but less then R Xr is the groove axial dimension at radius P is an outer radius of the housing, and r is a radially inward radial position within the interior chamber whereat the dimension Xr of the groove is less than the dimension Xm of the groove, wherein the engagement portion of the housing wall of the housing end portion further includes inwardly projecting engagement members configured to deform and partially penetrate the insulation jacket along a periphery thereof to secure the housing wall to the insulation jacket.

57. The connector of claim 56, wherein said groove has a trapezoidal cross-sectional shape.

* * * * *